US010035349B2

(12) United States Patent
Tamaki

(10) Patent No.: US 10,035,349 B2
(45) Date of Patent: Jul. 31, 2018

(54) LIQUID EJECTION DEVICE

(71) Applicant: Brother Kogyo Kabushiki Kaisha, Nagoya-shi, Aichi-ken (JP)

(72) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/417,664

(22) Filed: Jan. 27, 2017

(65) Prior Publication Data

US 2017/0225465 A1 Aug. 10, 2017

(30) Foreign Application Priority Data

Feb. 5, 2016 (JP) ..... 2016-021366

(51) Int. Cl.
*B41J 2/165* (2006.01)
*B41J 2/01* (2006.01)
*B41J 2/175* (2006.01)

(52) U.S. Cl.
CPC ..... *B41J 2/16505* (2013.01); *B41J 2/01* (2013.01); *B41J 2/165* (2013.01); *B41J 2/1652* (2013.01); *B41J 2/16508* (2013.01); *B41J 2/16511* (2013.01); *B41J 2/16517* (2013.01); *B41J 2/175* (2013.01); *B41J 2/1752* (2013.01); *B41J 2/17509* (2013.01); *B41J 2/17513* (2013.01); *B41J 2/17553* (2013.01); *B41J 2002/16594* (2013.01)

(58) Field of Classification Search
None
See application file for complete search history.

(56) References Cited

U.S. PATENT DOCUMENTS 6,007,177 A 12/1999 Takanaka et al.
6,422,680 B1 * 7/2002 Hayakawa ..... B41J 2/16523 347/30
6,886,906 B2 * 5/2005 Maruyama ..... B41J 2/16511 347/29
8,794,739 B2 * 8/2014 Ikeda ..... B05B 15/02 347/22

(Continued)

FOREIGN PATENT DOCUMENTS

JP H08150734 A 6/1996
JP 3159878 B2 4/2001

(Continued)

*Primary Examiner* — Matthew Luu
*Assistant Examiner* — Tracey McMillion
(74) *Attorney, Agent, or Firm* — Banner & Witcoff, Ltd.

(57) ABSTRACT

A liquid ejection device includes an ejection head, a cap configured to cover the nozzle, a first liquid receiver including a first receiving surface and a discharge portion connected to the first receiving surface. The liquid ejection device includes a second liquid receiver including a second receiving surface positioned under the discharge portion. One of the first liquid receiver and the second liquid receiver has an engagement portion, and the other of the first liquid receiver and the second liquid receiver has an engaged portion. A play between the engagement portion and the engaged portion is smaller than a distance between both ends of the second receiving surface in the direction parallel to the second receiving surface.

20 Claims, 14 Drawing Sheets

(56) References Cited

U.S. PATENT DOCUMENTS

| | | | | |
|---|---|---|---|---|
| 2005/0212873 | A1* | 9/2005 | Usui | B41J 2/17513 347/84 |
| 2008/0143763 | A1* | 6/2008 | Sakurai | B41J 2/1707 347/6 |
| 2008/0192083 | A1* | 8/2008 | Nishida | B41J 2/16508 347/30 |
| 2014/0362139 | A1* | 12/2014 | Kanazawa | B41J 2/16511 347/29 |
| 2015/0336386 | A1 | 11/2015 | Shimazu | |

FOREIGN PATENT DOCUMENTS

| | | | |
|---|---|---|---|
| JP | 2002103649 | A | 4/2002 |
| JP | 2015217628 | A | 12/2015 |

* cited by examiner

LIQUID EJECTION DEVICE

CROSS-REFERENCE TO RELATED APPLICATION

This application claims priority from Japanese Patent Application No. 2016-021366 filed on Feb. 5, 2016, the content of which is incorporated herein by reference in its entirety.

TECHNICAL FIELD

Aspects disclosed herein relates to a liquid ejection device for ejecting liquid from nozzles.

BACKGROUND

An inkjet printer that performs printing onto a medium by ejecting liquid from nozzles has been known as an example of a liquid ejection device that ejects liquid from nozzles. In a case where nozzle clogging occurs in the known printer, cleaning is performed for discharging liquid from a liquid ejection unit to a cap (e.g., a first receiver) through the nozzles while the cap is positioned at a capping position where the cap contacts the liquid ejection unit. Subsequent to the cleaning, the cap is separated from the liquid ejection unit and then idle suction is performed for collecting liquid remaining in the cap by driving of a suction mechanism connected to the cap.

SUMMARY

In the known printer, prior to idle suction being performed subsequent to cleaning, the cap may be separated from the liquid ejection unit with liquid remaining in the cap. Therefore, at the time of separating the cap from the liquid ejection unit, the remaining liquid may spill from the cap. Depending on how the liquid spills, the spilt liquid may run to and adhere to, for example, a driving portion of the printer. If the liquid stays and solidifies at the driving portion, the solidified ink may impair operation of the printer.

Accordingly, some embodiments of the disclosure provide for a liquid ejection device in which liquid spilt from a cap may be clearly directed to an intended discharge route.

A liquid ejection device according to an aspect of the present invention includes an ejection head including a nozzle, a cap having a top side proximate the ejection head, the cap configured to cover the nozzle. The liquid ejection device includes a first liquid receiver including a first receiving surface positioned under the top side of the cap and a discharge portion connected to the first receiving surface, the discharge portion extending to a direction intersecting the first receiving surface and a second liquid receiver including a second receiving surface positioned under the discharge portion. One of the first liquid receiver and the second liquid receiver has an engagement portion, and the other of the first liquid receiver and the second liquid receiver has an engaged portion. A play between the engagement portion and the engaged portion in a direction parallel to the second receiving surface is smaller than a distance between both ends of the second receiving surface in the direction parallel to the second receiving surface.

According to the one or more aspects of the disclosure, liquid spilt from the cap may be received by the first liquid receiver and then discharged through the outlet. The liquid discharged through the outlet is then received by the second receiving surface. The restricting unit may restrict the relative movement between the first liquid receiver and the second liquid receiver within the range in which the second receiving surface and the outlet overlap each other in a horizontal dimension (i.e., the second receiving surface and the outlet are positioned vertically one above the other). Therefore, irrespective of the positional relationship between the first liquid receiver and the second liquid receiver that move relative to each other, the liquid discharged through the outlet may be received by the second receiving surface and thus the liquid spilt from the cap may be consistently directed to an intended discharge route.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Hereinafter, an illustrative embodiment will be described with reference to the accompanying drawings.

(Overall Configuration of Printer)

Figure 1:
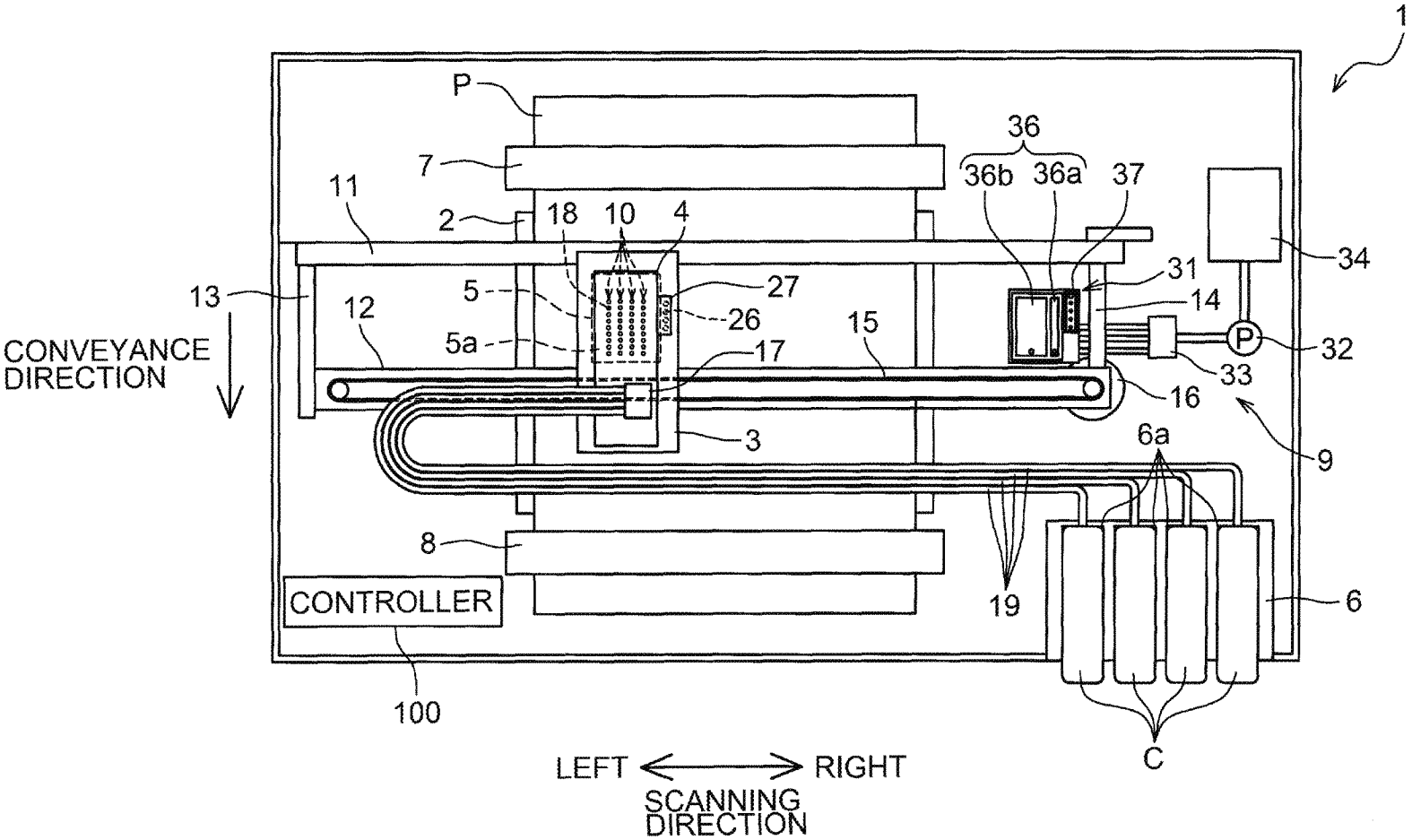
FIG. 1 illustrates an outline configuration of a printer in an illustrative embodiment according to one or more aspects of the disclosure.

As depicted in FIG. 1, a printer 1 includes a platen 2, a carriage 3, a sub-tank 4, an inkjet head 5, a cartridge holder 6, a conveying roller 7, a discharge roller 8, and a maintenance unit 9. Operation of the printer 1 is controlled by a controller 100.

The platen 2 is configured to support a recording sheet P (as an example of a recording medium) being conveyed by one or both of the conveying roller 7 and the discharge roller 8. A plurality of, for example, two, guide rails 11 and 12 are disposed above the platen 2. The guide rails 11 and 12 extend parallel to a scanning direction. The guide rails 11 and 12 are supported by frames 13 and 14 at their end portions in the scanning direction. The carriage 3 is configured to move in the scanning direction along the guide rails 11 and 12. An endless drive belt 15 is connected to the carriage 3. In response to driving of the drive belt 15 by a carriage motor 16, the carriage 3 moves in the scanning direction. In the description below, as depicted in FIG. 1, one direction of the scanning direction is defined as the right of the printer 1 and the other direction of the scanning direction is defined as the left of the printer 1.

Figure 2:
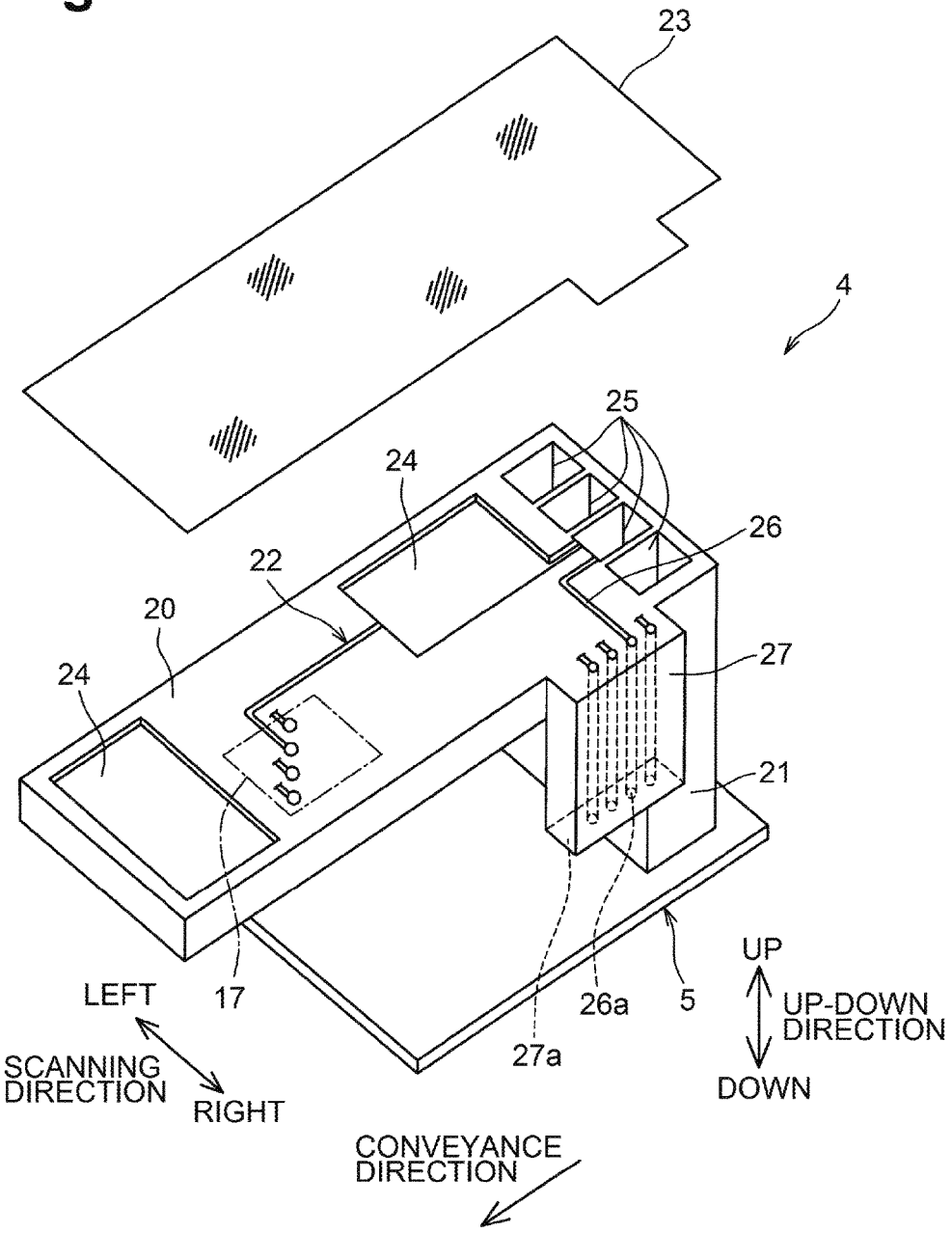
FIG. 2 is a perspective view depicting an outline configuration of a sub-tank and an inkjet head in the illustrative embodiment according to one or more aspects of the disclosure.
Figure 3:
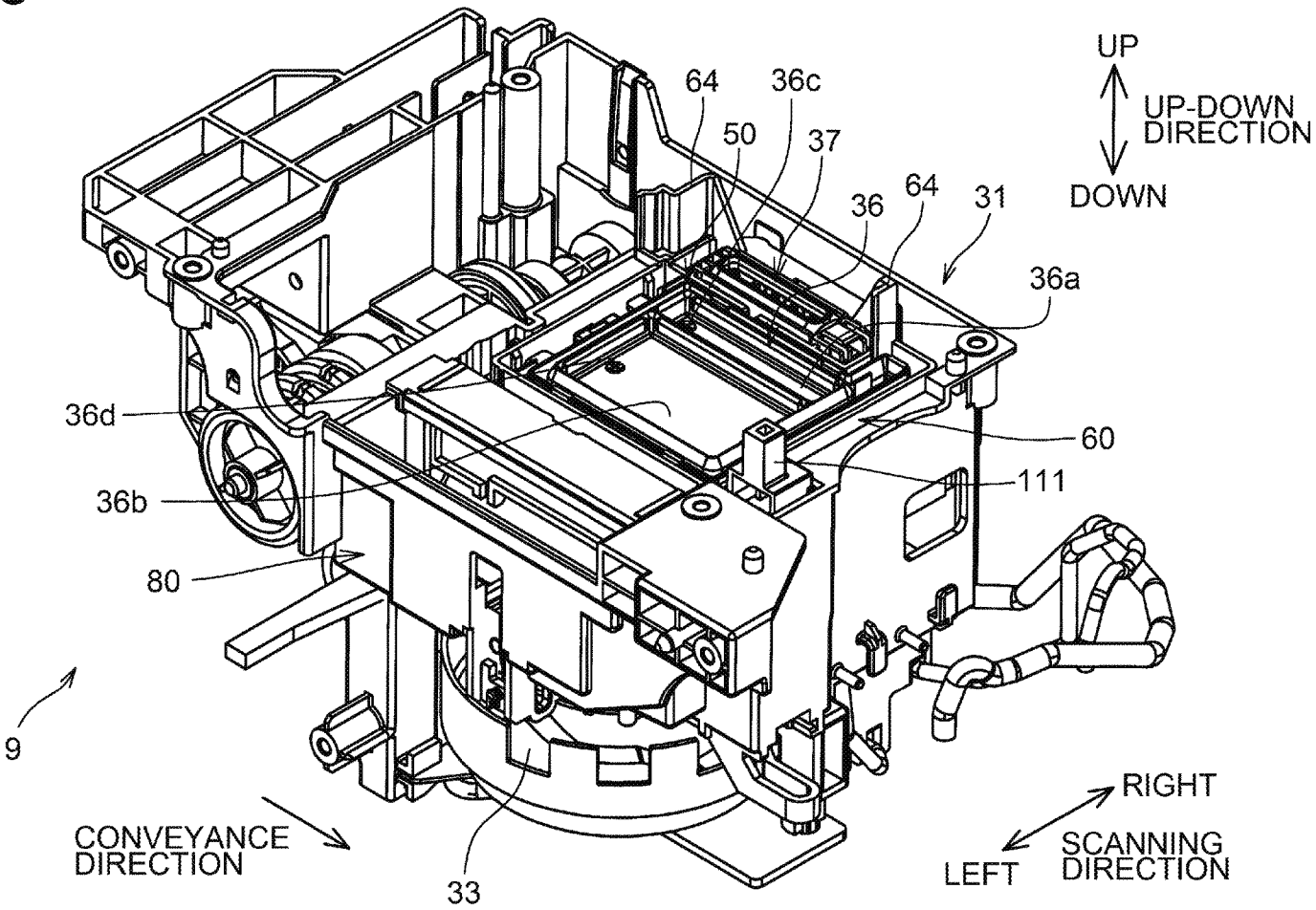
FIG. 3 is a top perspective view depicting a maintenance unit including a capping unit in the illustrative embodiment according to one or more aspects of the disclosure.
Figure 4:
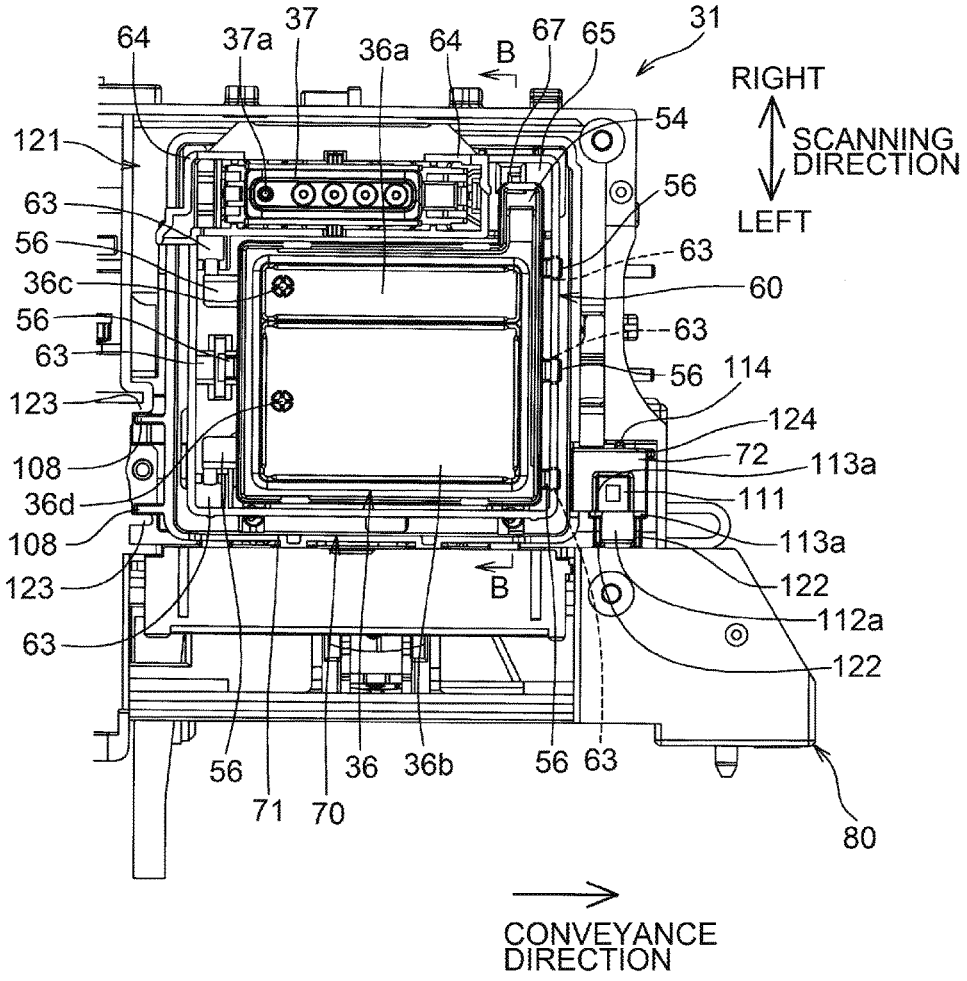
FIG. 4 is a plan view depicting a nozzle cap and its surrounding components of the capping unit in the illustrative embodiment according to one or more aspects of the disclosure.
Figure 5A:
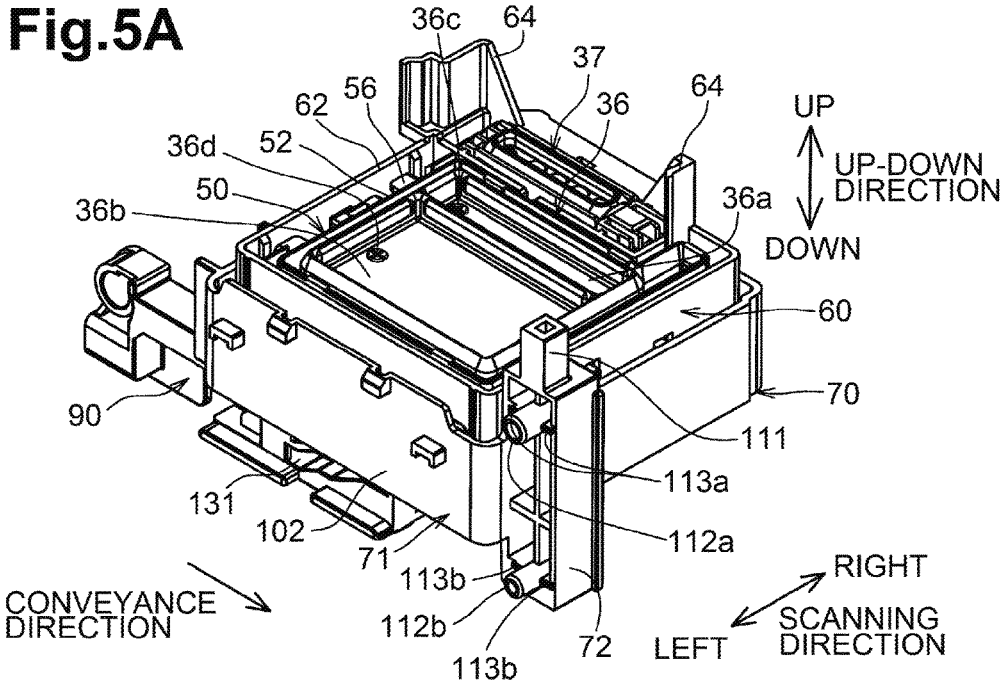
FIG. 5A is a top perspective view depicting the capping unit in the illustrative embodiment according to one or more aspects of the disclosure, wherein a base member is omitted.
Figure 5B:
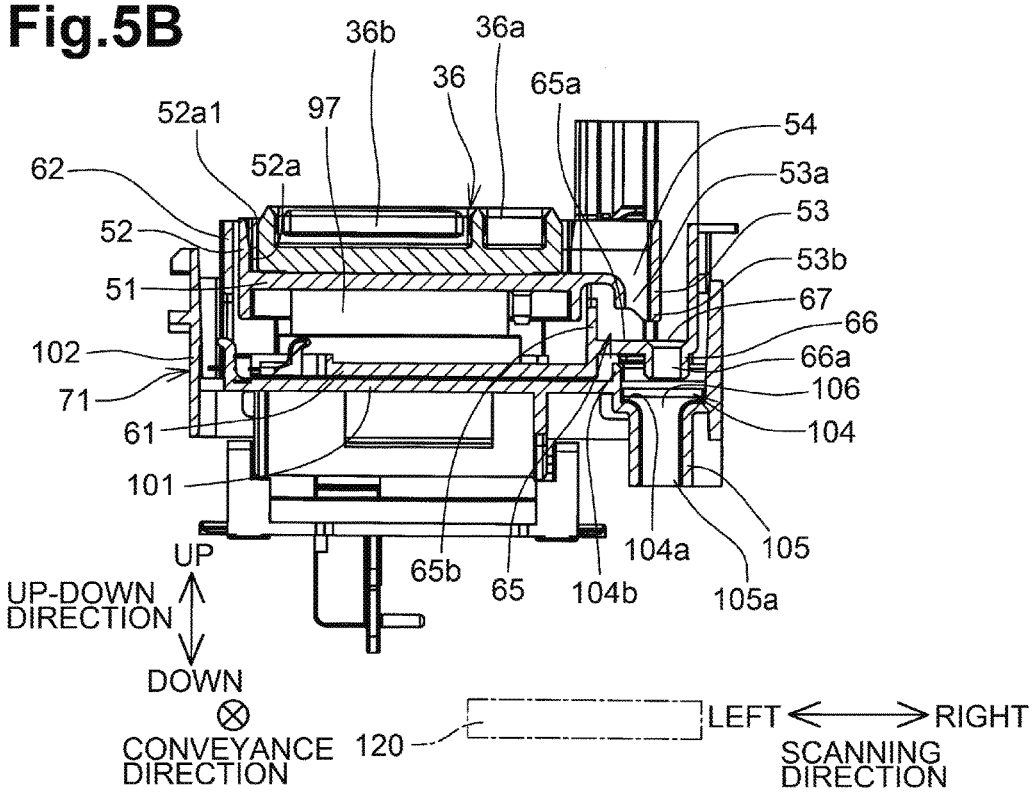
FIG. 5B is a sectional view depicting the capping unit taken along line B-B of FIG. 4 in the illustrative embodiment according to one or more aspects of the disclosure, wherein the base member is omitted.
Figure 6A:
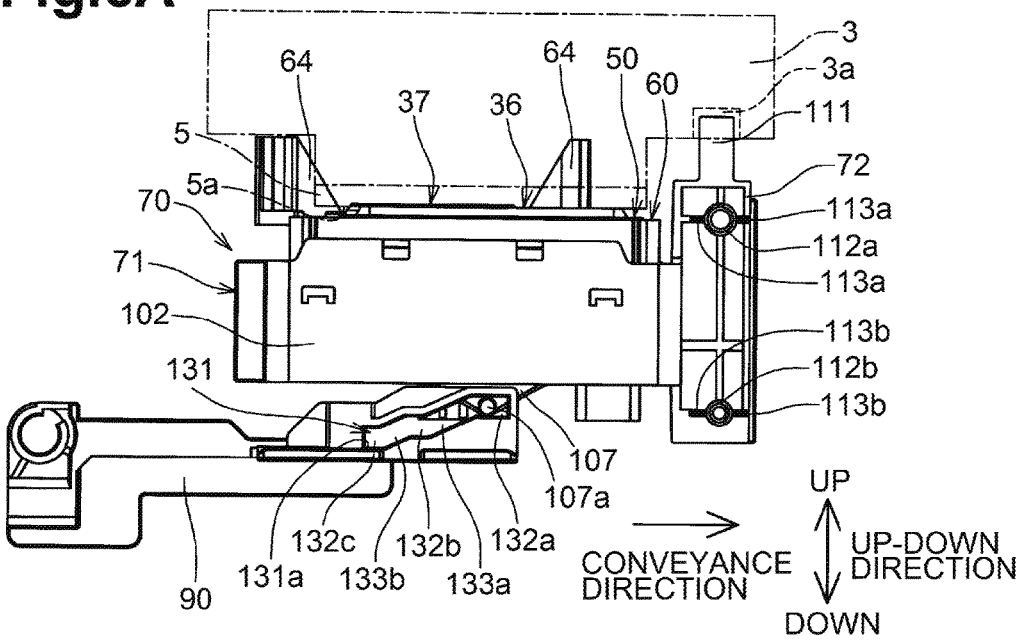
FIG. 6A is a left side view of the capping unit in the illustrative embodiment according to one or more aspects of the disclosure, wherein the base member is omitted.
Figure 6B:
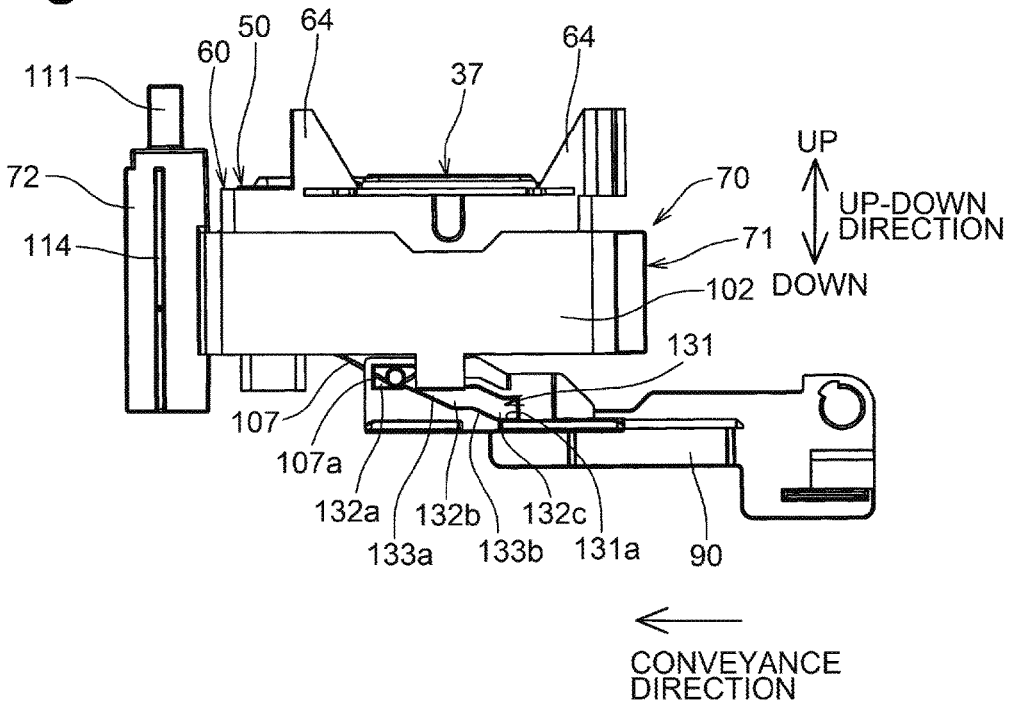
FIG. 6B is a right side view of the capping unit in the illustrative embodiment according to one or more aspects of the disclosure, wherein the base member is omitted.
Figure 7A:
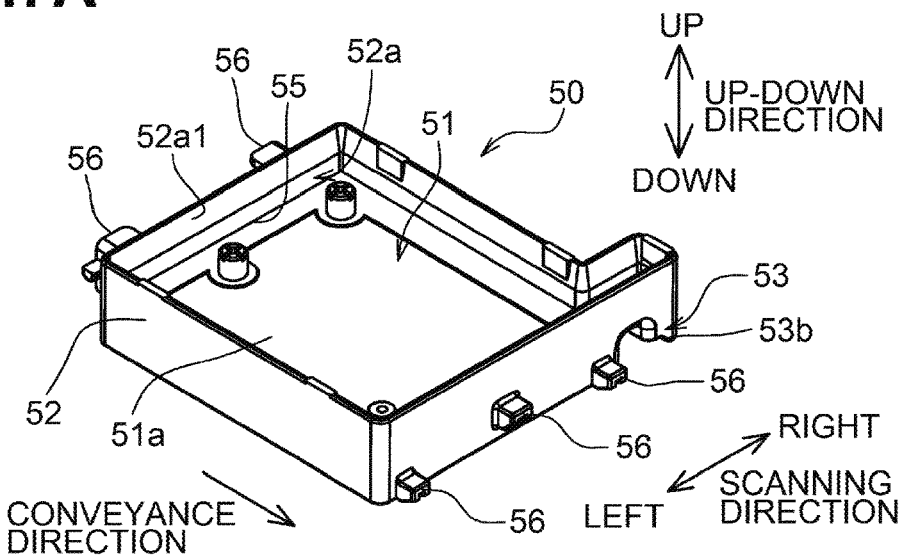
FIG. 7A is a top perspective view depicting a cap holder in the illustrative embodiment according to one or more aspects of the disclosure.
Figure 7B:
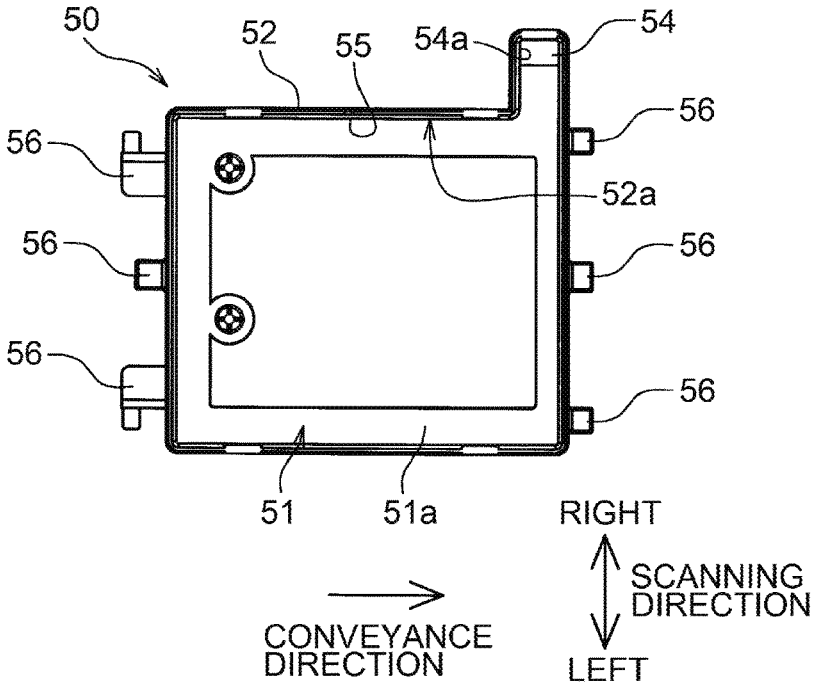
FIG. 7B is a top plan view depicting the cap holder in the illustrative embodiment according to one or more aspects of the disclosure.
Figure 8A:
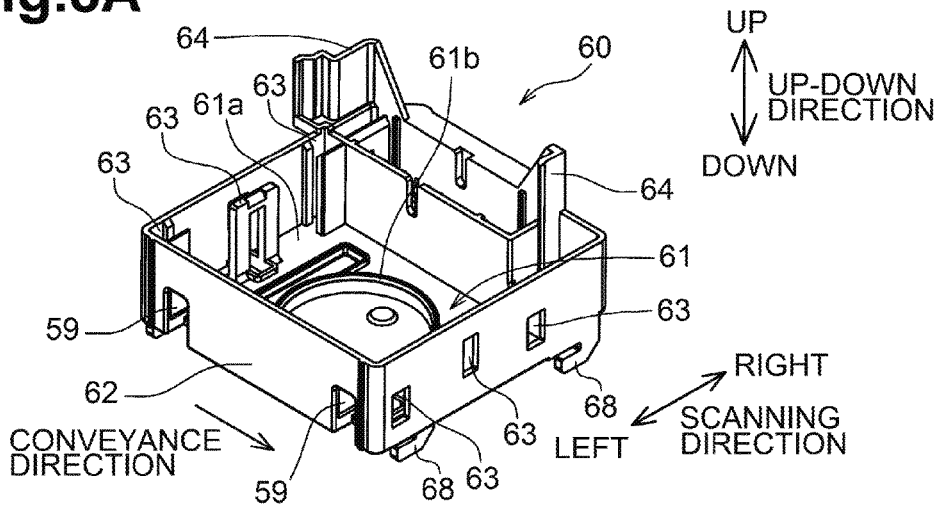
FIG. 8A is a top perspective view depicting a cap-lift holder in the illustrative embodiment according to one or more aspects of the disclosure.
Figure 8B:
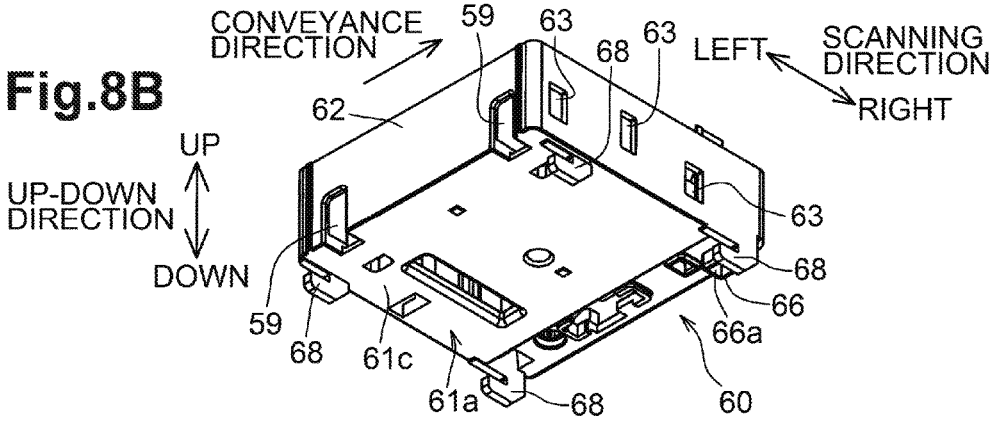
FIG. 8B is a bottom perspective view depicting the cap-lift holder in the illustrative embodiment according to one or more aspects of the disclosure.
Figure 8C:
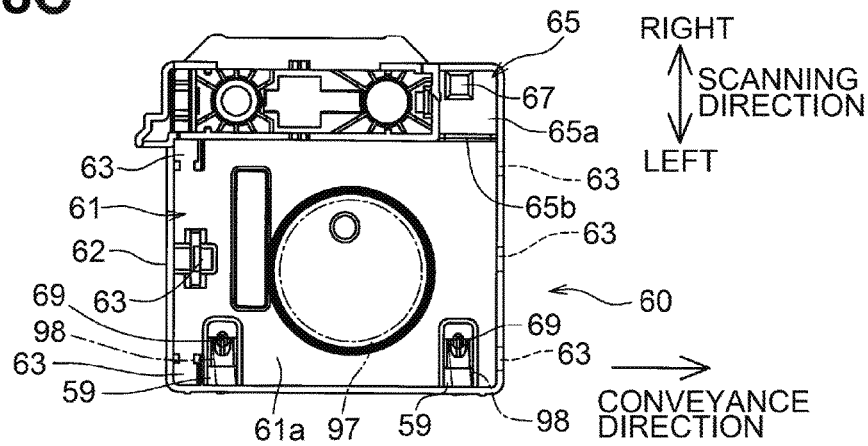
FIG. 8C is a top plan view depicting the cap-lift holder in the illustrative embodiment according to one or more aspects of the disclosure.
Figure 9A:
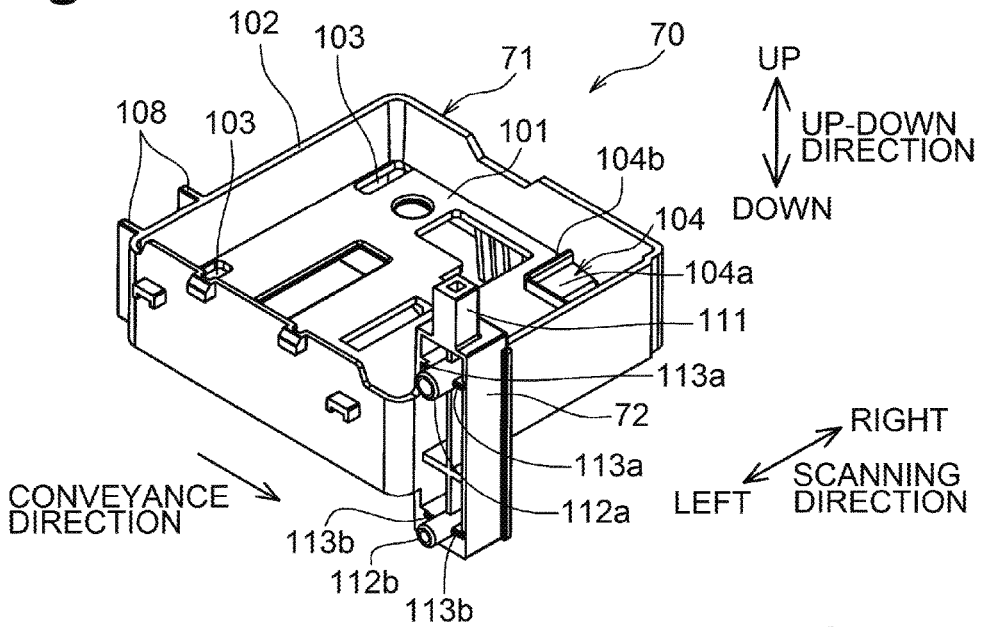
FIG. 9A is a top perspective view depicting a cap-lift base in the illustrative embodiment according to one or more aspects of the disclosure.
Figure 9B:
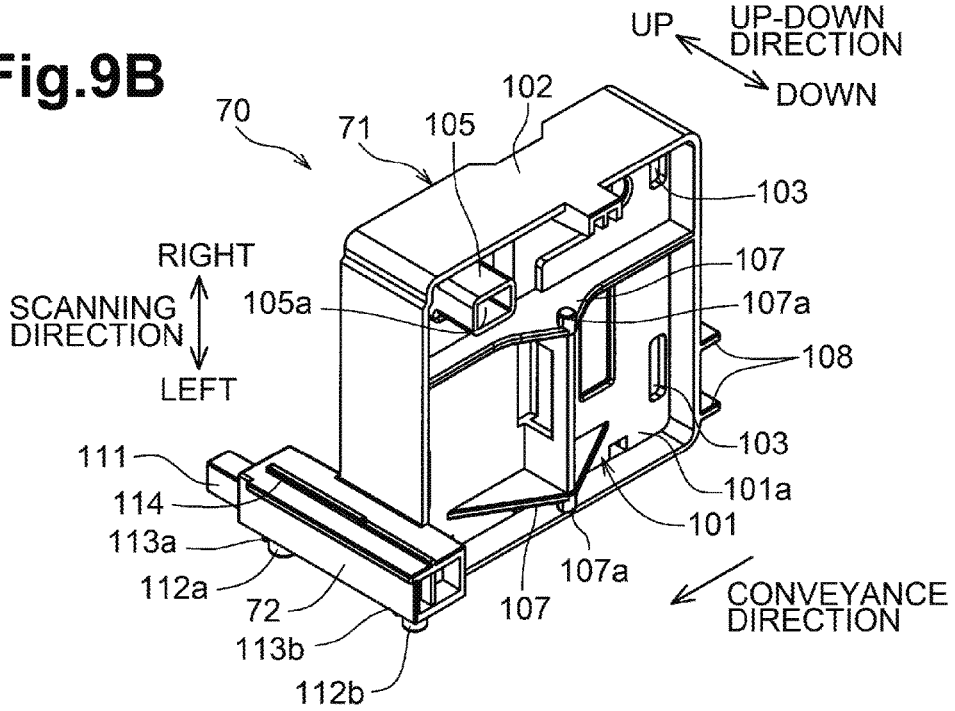
FIG. 9B is a bottom perspective view depicting the cap-lift base in the illustrative embodiment according to one or more aspects of the disclosure.
Figure 10A:
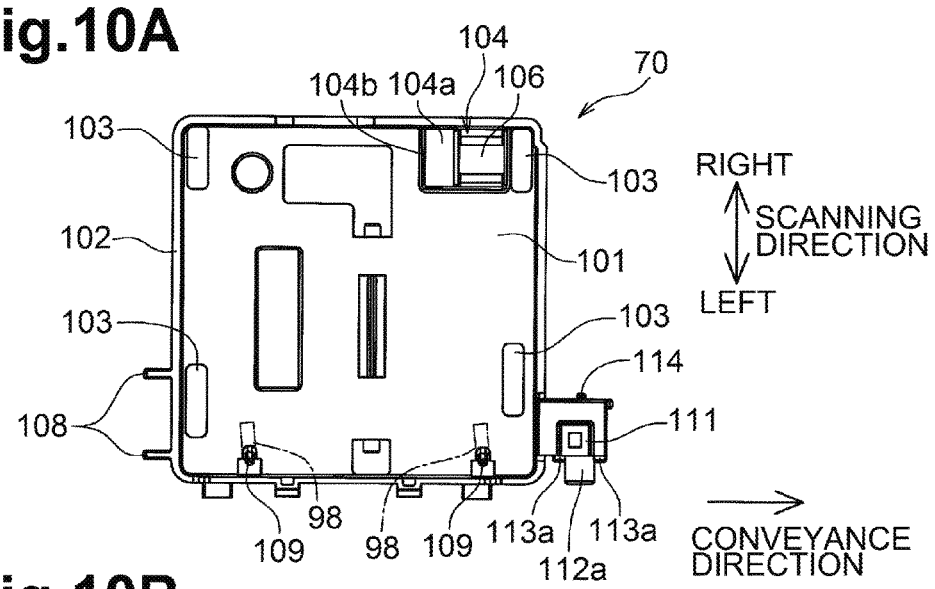
FIG. 10A is a top plan view depicting the cap-lift base in the illustrative embodiment according to one or more aspects of the disclosure.
Figure 10B:
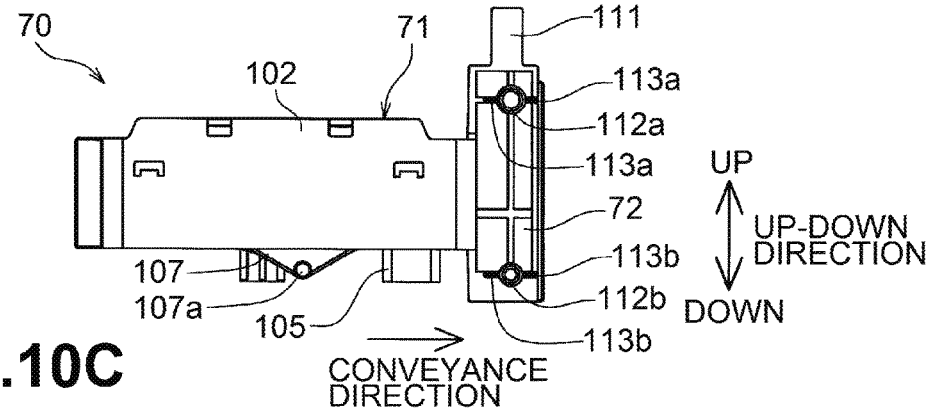
FIG. 10B is a left side view depicting the cap-lift base in the illustrative embodiment according to one or more aspects of the disclosure.
Figure 10C:
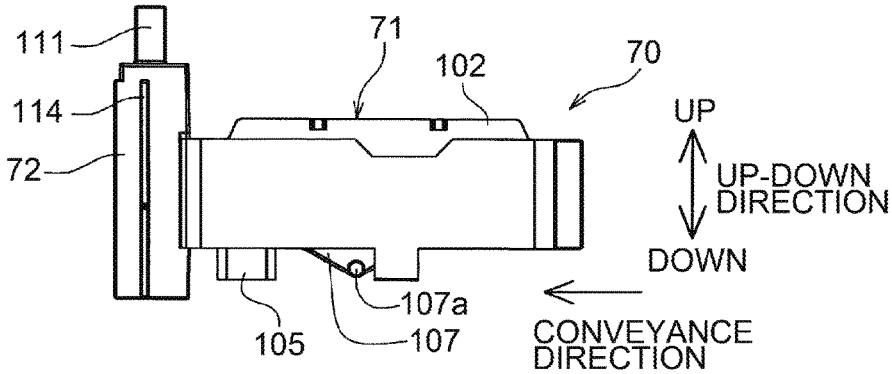
FIG. 10C is a right side view depicting the cap-lift base in the illustrative embodiment according to one or more aspects of the disclosure.
Figure 11A:
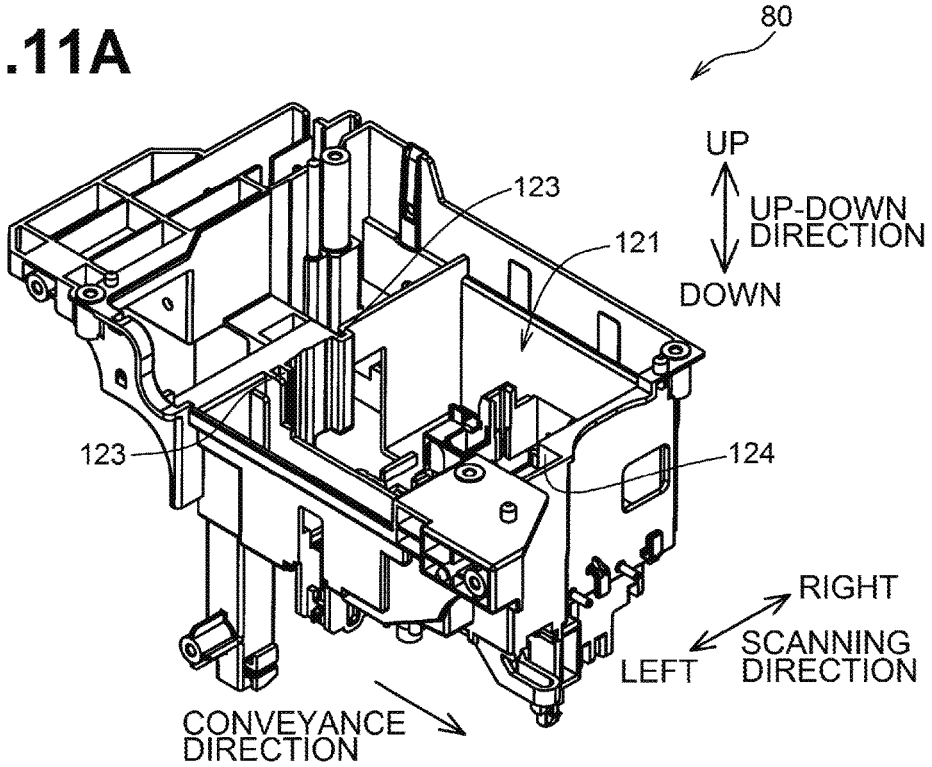
FIG. 11A is a top perspective view depicting the base member in the illustrative embodiment according to one or more aspects of the disclosure.
Figure 11B:
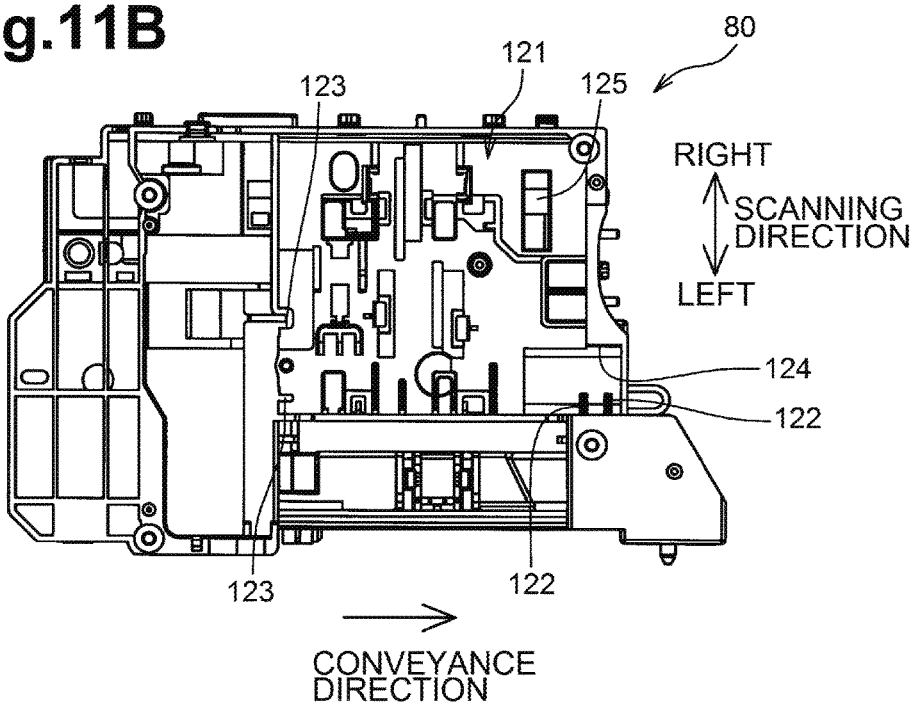
FIG. 11B is a top perspective view depicting the base member in the illustrative embodiment according to one or more aspects of the disclosure.

The sub-tank 4 is mounted on the carriage 3. As depicted in FIGS. 1 and 2, the sub-tank 4 includes a tube joint 17 at its upper surface. The tube joint 17 is connected to the cartridge holder 6 via a plurality of, for example, four, tubes 19. The sub-tank 4 further includes an air exhaustion unit 27 at its right end portion. The air exhaustion unit 27 is configured to exhaust air bubbles intruding in channels of the sub-tank 4.

The cartridge holder 6 includes a plurality of, for example, four, cartridge mounts 6*a* disposed side by side in the scanning direction. The cartridge mounts 6*a* are configured to support respective ink cartridges C attached thereto. In FIG. 1, the ink cartridges C are attached to the respective cartridge mounts 6*a* and the ink cartridges C store pigment inks of black, yellow, cyan, and magenta, respectively, in this sequence from the right. The inks stored in the respective ink cartridges C attached to the respective cartridge mounts 6*a* are supplied to the sub-tank 4 via the respective tubes 19.

The inkjet head 5 is attached to a bottom of the sub-tank 4. The inkjet head 5 has ink channels including a plurality of nozzles 18 defined in its lower surface. The lower surface of the inkjet head 5 may be an ink ejection surface 5*a*. The inkjet head 5 is supplied with ink from the sub-tank 4 and ejects ink from the nozzles 18. The nozzles 18 are aligned in, a plurality of, for example, four, rows along a conveyance direction orthogonal to the scanning direction to constitute a plurality of, for example, four, nozzle rows 10. The nozzle rows 10 are positioned side by side in the scanning direction and eject respective different color inks. More specifically, for example, the nozzle rows 10 are configured to eject magenta ink, cyan ink, yellow ink, and black ink, respectively, in this sequence from the left in the scanning direction.

The maintenance unit 9 is disposed at a maintenance position to the right of the platen 2 in the scanning direction. The maintenance unit 9 is configured to perform a maintenance operation for maintaining and recovering ejection performance of the inkjet head 5.

(Sub-Tank)

As depicted in FIG. 2, the sub-tank 4 further includes a body 20 and a connector 21. The body 20 extends along the horizontal plane. The connector 21 extends vertically downward from an upstream end portion of the body 20 in the conveyance direction. The sub-tank 4 has a plurality of, for example, four, ink supply channels 22 in which the respective inks for the respective nozzle rows 10 flow. In FIG. 2, for simplicity purpose, one of the ink supply channels 22 is depicted entirely and the remainder of the ink supply channels 22 are omitted partially.

Each of the ink supply channels 22 includes a damper chamber 24 and a communication chamber 25. The damper chambers 24 are defined in the body 20, and the communication chambers 25 are defined in the connector 21. A flexible film 23 is adhered to each of upper and lower surfaces of the body 20. Channels including the damper chambers 24 of the body 20 are covered by the films 23. The damper chambers 24 is configured to absorb pressure fluctuation of ink flowing in the respective ink supply channels 22 using deformation of the films 23. The connector 21 of the sub-tank 4 is connected to the inkjet head 5. Inks flowing in the ink supply channels 22 are supplied to the inkjet head 5 through the respective communication chambers 25 defined in the connector 21.

As depicted in FIG. 2, the body 20 has a plurality of, four, air exhaustion channels 26 defined therein. The air exhaustion channels 26 are connected to the respective ink supply channels 22. In FIG. 2, for simplicity purpose, one of the air exhaustion channels 26 is depicted entirely and the remainder of the air exhaustion channels 26 are omitted partially.

Each of the air exhaustion channels 26 extends to the air exhaustion unit 27 disposed at the right end portion of the sub-tank 4. Each of the air exhaustion channels 26 includes a portion extending inside the air exhaustion unit 27 in an up-down direction and has an opening 26*a* at its lower end. The air exhaustion unit 27 has a lower surface that may be an air exhaustion surface 27*a*. The openings 26*a* for the respective air exhaustion channels 26 are aligned in the conveyance direction at the air exhaustion surface 27*a*. A valve (not depicted) for closing and opening a corresponding air exhaustion channel 26 is disposed in the up-down extending portion of each of the air exhaustion channels 26. The up-down direction refers to a direction in which gravity acts.

(Maintenance Unit)

As depicted in FIG. 1, the maintenance unit 9 includes a capping unit 31, a suction pump 32, a switching device 33, and a wasted liquid tank 34.

(Capping Unit)

As depicted in FIGS. 3, 4, 5A, 5B, 6A, and 6B, the capping unit 31 includes a nozzle cap 36, an air exhaustion cap 37, a cap holder 50, a cap-lift holder 60, a cap-lift base 70, a base member 80, and a slide cam 90.

The nozzle cap 36 may be made of, for example, rubber material. As depicted in FIGS. 1, 3, 4, 5A, and 5B, the nozzle cap 36 includes a cap 36*a* and a cap 36*b*. The cap 36*b* is disposed to the left of the cap 36*a*. When the carriage 3 is located at the maintenance position, the cap 36*a* faces the rightmost one of the nozzle rows 10 and the cap 36*b* faces the remainder (e.g., the other three) of the nozzle rows 10. The caps 36*a* and 36*b* have suction ports 36*c* and 36*d*, respectively, at their upstream end portions in the conveyance direction. The caps 36*a* and 36*b* are each connected to the switching device 33 via respective tubes at the respective suction ports 36*c* and 36*d*.

The air exhaustion cap 37 may be made of, for example, rubber material. As depicted in FIGS. 1, 3, 4, 5A, and 5B, the air exhaustion cap 37 is disposed to the right of the nozzle cap 36. When the carriage 3 is located at the maintenance position, the air exhaustion cap 37 faces the air exhaustion surface 27*a* of the air exhaustion unit 27. The air exhaustion cap 37 has a suction port 37*a* at its upstream end portion in the conveyance direction. The air exhaustion cap 37 is connected to the switching device 33 via a tube at the suction port 37*a*. The air exhaustion cap 37 is shorter in length in the conveyance direction than the nozzle cap 36. An upstream end of the nozzle cap 36 is substantially aligned with an upstream end of the air exhaustion cap 37 with respect to the conveyance direction.

(Cap Holder)

As depicted in FIGS. 3, 4, 5A, 5B, 7A, and 7B, the cap holder 50 has a substantially rectangular shape in plan view. The cap holder 50 has a box-like shape with its upper end opened. The nozzle cap 36 is placed in the cap holder 50 and supported by the cap holder 50. More specifically, for example, the nozzle cap 36 is placed on an upper surface 51*a* of a bottom wall 51 of the cap holder 50. The bottom wall 51 constitutes a lower portion of the cap holder 50. The cap holder 50 has a sidewall 52 that extends upward from an outer circumferential end of the bottom wall 51. The outer circumferential end of the bottom wall 51 protrudes relative to the nozzle cap 36. The nozzle cap 36 is surrounded by the sidewall 52 of the cap holder 50 entirely. Nevertheless, the sidewall 52 might not necessarily surround the nozzle cap 36 entirely. In other embodiments, for example, the sidewall 52 may have a cut portion and the nozzle cap 36 may be exposed partially through the cut portion. The sidewall 52 has an inner wall surface 52*a*. An upper end portion of the wall surface 52*a* has a tapered portion 52*a*1 that is inclined downward toward the center of the cap holder 50 (e.g., toward the nozzle cap 36) from an upper end of the inner wall surface 52*a*.

The bottom wall 51 includes an extended portion. The extended portion is disposed at a downstream end portion in the conveyance direction and extends further to the right than the other portion of the bottom wall 51 from a right end of the downstream end portion in the scanning direction. The extended portion is located to the right of the nozzle cap 36 in the scanning direction and downstream of the air exhaustion cap 37 in the conveyance direction. The extended portion of the bottom wall 51 has an outlet 54 for discharging ink spilt on the cap holder 50 from the nozzle cap 36. The cap holder 50 has a plurality of, for example, four, wall surfaces 54*a*. The wall surfaces 54*a* define the outlet 54, and three of the wall surfaces 54*a* are contiguous to the wall surface 52*a* in the up-down direction. In various examples, the outlet 54 may be solely in bottom wall 51, solely in wall surfaces 54*a*, or in a combination of both bottom wall 51 and wall surfaces 54*a*.

The cap holder 50 further includes a tubular portion 53 at a lower surface of the bottom wall 51. The tubular portion 53 has a substantially rectangular tubular shape. The tubular portion 53 is positioned vertically below the outlet 54 and extends downward from the bottom wall 51. The tubular portion 53 has an internal space 53*a* that is in communication with the outlet 54. The tubular portion 53 has a right end portion that may be a projecting portion 53*b* extending downward farther than the other portion thereof.

The sidewall 52 includes a plurality of, three, protrusions 56 at its upstream outer surface in the conveyance direction. The upstream protrusions 56 are positioned side by side in the scanning direction. The sidewall 52 further includes a plurality of, three, protrusions 56 at its downstream outer surface in the conveyance direction. The downstream protrusions 56 are positioned side by side in the scanning direction.

(Cap-Lift Holder)

As depicted in FIGS. 3, 4, 5A, 5B, 8A, 8B, and 8C, the cap-lift holder 60 has a substantially rectangular shape in plan view. The cap-lift holder 50 has a box-like shape with its upper end opened. The cap holder 50 is placed in the cap-lift holder 60 and supported by the cap-lift holder 60. The cap-lift holder 60 includes a bottom wall 61 which constitutes a lower portion of the cap-lift holder 60. A coil spring 97 is disposed at a substantially central portion of an upper surface 61*a* of the bottom wall 61. The cap holder 50 is attached with an upper end portion of the coil spring 97 and is urged upward by the coil spring 97. The cap-lift holder 60 has a sidewall 62 that extends upward from an outer circumferential end of the bottom wall 61. The outer circumferential end of the bottom wall 61 protrudes relative to the cap holder 50. The cap holder 50 is surrounded by the sidewall 62 of the cap-lift holder 60 entirely. Nevertheless, the sidewall 62 might not necessarily surround the cap holder 50 entirely. In other embodiments, for example, the sidewall 62 may have a cut portion and the cap holder 50 may be exposed partially through the cut portion.

The sidewall 62 of the cap-lift holder 60 has a plurality of engagement portions 63 for engaging with the respective protrusions 56. The cap holder 50 and the cap-lift holder 60 are joined to each other by engagement of the protrusions 56 with the respective engagement portions 63. The protrusions 56 are movable within the respective engagement portions 63 in the up-down direction. When the downstream protrusions 56 are located at their respective highest positions within the respective downstream engagement portions 63, the downstream protrusions 56 are located lower than the upstream protrusions 56 located at their respective highest positions within the respective upstream engagement portions 63. In a state where the nozzle cap 36 is separated from the ink ejection surface 5*a*, an upward movement of the cap holder 50 upwardly urged by the coil spring 97 is restricted by the engagement of the engagement portions 63 and the respective protrusions 56. With this configuration, therefore, in the state where the nozzle cap 36 is separated from the ink ejection surface 5*a*, the nozzle cap 36 and the cap holder 50 are tilted relative to the conveyance direction such that downstream portions of the nozzle cap 36 and the cap holder 50 are located lower than upstream portions thereof in the conveyance direction (refer to FIGS. 12A and 12B). That is, the engagement portions 63 restrict the upward movement of the cap holder 50 such that the downstream portions of the nozzle cap 36 and the cap holder 50 are located lower than the upstream portions thereof in the conveyance direction. The engagement portions 63 are an example of a support structure that supports the cap holder 50. Another example of a support structure may include inner surfaces of sidewalls 62 that position cap holder 50 via contact with one or more outer surfaces of sidewalls 52. Yet another example may include other surfaces of the cap-lift holder 60 that contact surfaces of cap holder 50. Other examples will be apparent to those of ordinary skill in the art.

The sidewall 62 includes contact portions 64 at its right portion in the scanning direction. The contact portions 64 are disposed at upstream and downstream portions, respectively, of the right portion of the sidewall 62 in the conveyance direction, and extend upward therefrom. The contact portions 64 are configured to contact a right end of the inkjet head 5 when the carriage 3 is located at the maintenance position.

The cap-lift holder 60 further includes an ink receiving portion 65 vertically below the outlet 54. The ink receiving portion 65 is configured to receive ink discharged through the outlet 54. The ink receiving portion 65 has a box-like shape with its upper end opened. The ink receiving portion 65 has a lower portion that is constituted by a portion of the bottom wall 61. The ink receiving portion 65 has an upper surface 65*a* and is configured to receive ink by the upper surface 65*a*. The bottom wall 61 includes a partition wall 65*b*. The partition wall 65*b* extends upward from an end of the upper surface 65*a* of the ink receiving portion 65. The upper surface 65*a* is surrounded by the partition wall 65*b* and a portion of the sidewall 52. Therefore, this configuration may reduce or prevent ink received by the upper surface 65*a* from running out of the ink receiving portion 65. The ink receiving portion 65 has an outlet 67 defined in a right end portion of the upper surface 65*a* in the scanning direction. The cap-lift holder 60 further includes a tubular portion 66 at a lower surface 61*c* of the bottom wall 61. The tubular portion 66 has a substantially rectangular cylindrical shape. The tubular portion 66 is positioned vertically below the outlet 67 and extends downward from the bottom wall 61. The tubular portion 66 has an internal space 66*a* that is in communication with the outlet 67.

As the cap holder 50 is tilted as described above, the cap holder 50 and the cap-lift holder 60 move relative to each other and thus the outlet 54 moves horizontally relative to the ink receiving portion 65. In the illustrative embodiment, even when a positional relationship between the cap holder 50 and the cap-lift holder 60 changes due to the relative movement therebetween, the outlet 54 is always positioned vertically above the upper surface 65*a* of the ink receiving portion 65. That is, the relative movement of the cap holder 50 and the cap-lift holder 60 is restricted within a range in which the outlet 54 is positioned vertically above the upper surface 65*a* of the ink receiving portion 65 (i.e., within a range in which the outlet 54 overlaps the upper surface 65*a* of the ink receiving portion 65 in a horizontal dimension). When the cap holder 50 and the cap-lift holder 60 move relative to each other, it is preferable that the projecting portion 53*b* of the tubular portion 53 is always positioned vertically above the outlet 67. That is, it is preferable that the relative movement between the cap holder 50 and the cap-lift holder 60 be restricted within a range in which the outlet 54 is positioned vertically above the outlet 67 (i.e., within a range in which the projecting portion 53*b* of the tubular portion 53 overlaps the outlet 67 in a horizontal dimension).

In the illustrative embodiment, the engagement portions 63 have a larger size than the respective protrusions 56 in the scanning direction (e.g., the engagement portions 63 are larger than a tolerance of the respective portions 56). That is, there is some play between each of the protrusions 56 and a corresponding one of the engagement portions 63 in the scanning direction. The play (the amount of relative movement) is smaller than a distance between the ends of the upper surface 65*a* of the ink receiving portion 65 in the scanning direction. Therefore, even when the positional relationship between the cap holder 50 and the cap-lift holder 60 changes due to the relative movement therebetween, the outlet 54 is always positioned vertically above the upper surface 65*a* of the ink receiving portion 65. In the example of contact between inner surfaces of sidewalls 62 and outer surfaces of sidewalls 52, the inner surfaces of sidewalls 62 may be separated by a distance greater than the distance between the outer surfaces of sidewalls 52, thereby providing the relative movement (or play) between the cap holder and cap-lift holder 60. In the example of surfaces of the cap-lift holder 60 and contact surfaces of cap holder 50, the distance between the surfaces of the cap-lift holder 60 may be greater than the distance between the related surfaces of the cap holder 50, thereby providing play between the cap holder 50 and the cap-lift holder 60. As stated above, the supporting structures are not limited to these examples but may also include alternatives where the relative play between the cap holder 50 and the cap-lift holder 60 may be provided by interaction between other items including, for instance, a cap 36 with protrusions that possibly extend beyond sidewalls 52 of cap holder 50 and fit within engagement portions from sidewalls 62 and further examples of protrusions on inner surfaces of sidewalls 62 that face inward and interact with engagement portions in cap holder 50 or in cap 36.

In the illustrative embodiment, at least a lower end of the projecting portion 53*b* of the tubular portion 53 is always located lower than an upper end of the partition wall 65*b* of the ink receiving portion 65. That is, the projecting portion 53*b* is positioned further to the right than the partition wall 65*b* in the scanning direction and within the extension range of the upper surface 65*a* of the ink receiving portion 65 while overlapping the partition wall 65*b* in a vertical dimension (i.e., the projecting portion 53*b* has a portion that is positioned at the same level as a portion of the partition wall 65*b*).

The cap-lift holder 60 further includes a plurality of, for example, four, hooks 68 at respective four corners of the lower surface 61*c* of the bottom wall 61. The hooks 68 extend downward from the respective portions of the lower surface 61*c*. The cap-lift holder 60 further includes spring retaining portions 69 at the upper surface 61*a* of the bottom wall 61. The spring retaining portions 69 are disposed vertically above the left two of the hooks 68, respectively, in the scanning direction. Each of the spring retaining portions 69 is attached with one end of a corresponding one of the coil springs 98. An opening 59 is defined to the left of each of the spring retaining portions 69 in the scanning direction and extends between the bottom wall 61 and the sidewall 62. The coil springs 98 extend to the outside of the cap-lift holder 60 through the respective openings 59.

The cap-lift holder 60 may be made of material having relatively low rigidity, for example, polyacetal.

(Cap-Lift Base)

As depicted in FIGS. 3, 4, 5A, 5B, 9A, 9B, 10A, 10B, and 10C, the cap-lift base 70 includes a case 71 and a first projecting portion 72. The case 71 has a box-like shape with its upper end opened. The cap-lift holder 60 is placed in the case 71 and is supported by the case 71. More specifically, for example, the cap-lift holder 60 is placed on an upper surface of a bottom wall 101, which constitutes a lower portion of the case 71. The cap-lift base 70 has a sidewall 102 that extends upward from an outer circumferential end of the bottom wall 101. The outer circumferential end of the bottom wall 101 protrudes relative to the cap-lift holder 60. The cap-lift holder 60 is surrounded by the sidewall 102 of the cap-lift base 70 entirely. Nevertheless, the sidewall 102 might not necessarily surround the cap-lift holder 60 entirely. In other embodiments, for example, the sidewall 102 may have a cut portion and the cap-lift holder 60 may be exposed partially through the cut portion. The air exhaustion cap 37 is also supported by the cap-lift base 70.

The bottom wall 101 of the case 71 has a plurality of, for example, four, through holes 103 with which the hooks 68 are engaged respectively. The through holes 103 extend in the scanning direction. The hooks 68 are movable within the respective through holes 103 in the scanning direction. The bottom wall 101 includes spring retaining portions 109 in the vicinity of left two, respectively, of the through holes 103. Each of the spring retaining portions 109 is attached with the other end of a corresponding one of the coil springs 98 while each of the spring retaining portions 69 is attached with the one end of a corresponding one of the coil springs 98. The coil springs 98 may be, for example, tension springs. The cap-lift holder 60 is urged leftward by urging force of the coil springs 98.

The hooks 68 of the cap-lift holder 60 are movable within the respective through holes 103 and the cap-lift holder 60 is urged leftward by the coil springs 98. This configuration may enable the cap-lift holder 60 to translate and rotate relative to the case 71 within the horizontal plane. The hooks 68 are movable only within the respective through holes 103. Therefore, this configuration restricts the range of translation and rotation of the cap-lift holder 60 relative to the cap-lift base 70 within the horizontal plane.

In the illustrative embodiment, the cap-lift base 70 has the through holes 103. Nevertheless, in other embodiments, for example, the cap-lift base 70 may have recesses with which the hooks 68 are engaged. In still other embodiments, for example, the case 71 may include hooks extending upward from its upper surface and the cap-lift holder 60 may have through holes or recesses defined in the bottom wall 61. In this case, the recesses may be defined in a lower surface of the bottom wall 61.

The cap-lift base 70 further includes an ink receiving portion 104 vertically below the tubular portion 66 of the case 71. The ink receiving portion 104 has a box-like shape with an upper end opened. The ink receiving portion 104 includes a lower portion that is constituted by a portion of the bottom wall 101. The ink receiving portion 104 is configured to receive ink by its upper surface 104*a*. The bottom wall 101 includes a partition wall 104*b*. The partition wall 104*b* extends upward from an end of the upper surface 104*a* of the ink receiving portion 104. The upper surface 104*a* is surrounded by the partition wall 104*b* and a portion of the sidewall 102. Therefore, this configuration may reduce or prevent ink received by the upper surface 104*a* from running out of the ink receiving portion 104. The ink receiving portion 104 has an outlet 106 defined in a right end portion of the upper surface 104*a* in the scanning direction. The cap-lift base 70 further includes a tubular portion 105 at a lower surface 101*a* of the bottom wall 101. The tubular portion 105 has a substantially rectangular cylindrical shape. The tubular portion 105 is positioned vertically below the outlet 106 and extends downward from the bottom wall 101. The tubular portion 105 has an internal space 105*a* that is in communication with the outlet 106.

The cap-lift holder 60 is configured to rotate relative to the case 71 within the horizontal plane. In the illustrative embodiment, even when a positional relationship between the cap-lift holder 60 and the case 71 changes due to rotation of the cap-lift holder 60 relative to the case 71 within the horizontal plane, the outlet 67 of the cap-lift holder 60 is always positioned vertically above the upper surface 104*a* of the ink receiving portion 104 of the case 71. That is, the relative movement between the cap-lift holder 60 and the cap-lift base 70 is restricted within a range in which the outlet 67 is positioned vertically above the upper surface 104*a* of the ink receiving portion 104 (i.e., within a range in which the outlet 67 of the cap-lift holder 60 always overlap the upper surface 104*a* of the ink receiving portion 104 of the case 71 in a horizontal dimension). In this state, it is preferable that the outlet 67 is always positioned vertically above the outlet 106. That is, it is preferable that the relative movement between the cap-lift holder 60 and the cap-lift base 70 be restricted within the range in which the outlet 67 is positioned vertically above the outlet 106 (i.e., the range in which the outlet 67 always overlaps the outlet 106 in a horizontal dimension).

In the illustrative embodiment, even when the positional relationship between the cap-lift holder 60 and the case 71 changes due to rotation of the cap-lift holder 60 relative to the case 71 within the horizontal plane, a lower end of the tubular portion 66 is always located lower than an upper end of the partition wall 104*b* of the ink receiving portion 104. That is, the tubular portion 66 and the ink receiving portion 104 overlap each other in a vertical dimension (i.e., the tubular portion has a portion that is positioned at the same level as a portion of the ink receiving portion 104).

The case 71 further includes ribs 107 at the lower surface 101*a* of the bottom wall 101. The ribs 107 protrude downward from the lower surface 101*a* of the bottom wall 101 and extend in the conveyance direction. Each of the ribs 107 includes a protrusion 107*a* at its surface that does not face an opposite one of the ribs 107 in the scanning direction. Each of the protrusions 107*a* extends from the surface in a direction away from the opposite one of the ribs 107 with respect to the scanning direction. The protrusions 107*a* are aligned in the scanning direction. The case 71 further includes a plurality of, for example, two, second projecting portions 108 at an upstream outer surface thereof in the conveyance direction. The second projecting portions 108 are disposed side by side in the scanning direction. Each of the second projecting portions 108 extends upstream in the conveyance direction and has a height in the up-down direction.

The first projecting portion 72 has a substantially rectangular parallelepiped shape and extends in the up-down direction. The first projecting portion 72 is disposed at a downstream outer surface of the case 71 in the conveyance direction and at a left end portion of the downstream outer surface of the case 71. The first projecting portion 72 includes a carriage lock 111 that extends upward from an upper surface of the first projecting portion 72. The carriage lock 111 is configured to restrict movement of the carriage 3 in the scanning direction. The carriage lock 11 has a substantially rectangular parallelepiped shape. The carriage 3 has a recess 3*a* that is larger in size than the carriage lock 111. When a proximal end portion of the carriage lock 111 is positioned in the recess 3*a* (i.e., the carriage lock 111 and the carriage 3 overlap each other in a vertical dimension), the carriage lock 111 restricts the movement of the carriage 3 in the scanning direction. In a case where the carriage 3 attempts to move further leftward while the proximal end portion of the carriage lock 111 is positioned in the recess 3*a*, an inner wall surface defining the recess 3*a* contacts a right side surface of the carriage lock 111 in the scanning direction, thereby restricting the further leftward movement of the carriage 3. Both of the right side surface of the carriage lock 111 and the inner wall surface of the recess 3*a* extend parallel to each other in the up-down direction. Therefore, when the carriage 3 contacts the carriage lock 111 by moving leftward, the inner wall surface of the recess 3*a* does not slide upward relative to the right side surface of the carriage lock 111 by a continuous movement of the carriage 3. Thus, even if the carriage 3 is moved leftward continuously, the carriage lock 111 does not disengage from the recess 3*a* due to upward movement of the carriage 3. Consequently, the carriage lock 111 may restrict the movement of the carriage 3 in the scanning direction. Nevertheless, in other embodiments, for example, the carriage 3 might not have such a recess 3*a*. In this case, the carriage lock 111 may be configured to restrict the movement of the carriage 3 in the scanning direction by contacting a left side surface of the carriage 3.

The first projecting portion 72 includes bosses 112*a* and 112*b* at upper and lower end portions, respectively of a left end thereof. The bosses 112*a* and 112*b* extend leftward from the left end of the first projecting portion 72 and have a substantially circular tubular shape. The bosses 112*a* and 112*b* are aligned with the carriage lock 111 in the up-down direction. The first projecting portion 72 further includes ribs 113*a* and 113*b* at the left end thereof. The ribs 113*a* protrude leftward and are disposed adjacent to both sides of the boss 112*a* in the conveyance direction. The ribs 113*b* protrude leftward and are disposed adjacent to both sides of the boss 112*b* in the conveyance direction. While the boss 112*a* and the ribs 113*a* are located higher than the protrusions 107*a*, the boss 112*b* and the ribs 113*b* are located slightly lower than the protrusions 107*a*. The first projecting portion 72 further includes a ridge 114 at the right end thereof. The ridge 114 protrudes rightward and extends in the up-down direction.

The cap-lift base 70 may be made of material having higher rigidity than the cap-lift holder 60, e.g., mixed resin of polyphenylene ether and glass fiber.

(Base Member)

As depicted in FIGS. 3, 4, 11A, and 11B, the base member 80 includes an accommodating portion 121 for accommodating the cap-lift base 70. The accommodating portion 121 supports the cap-lift base 70 while allowing the cap-lift base 70 to move in the up-down direction. More specifically, for example, the accommodating portion 121 includes a plurality of, two, first guides 122. The first guides 122 extend in the up-down direction and are disposed such that the first guides 122 sandwich the bosses 112*a* and 112*b* therebetween in the conveyance direction. The bosses 112*a* and 112*b* slide relative to the first guides 122 while being guided by the first guides 122 in the up-down direction. The accommodating portion 121 has a guide surface 124 that is configured to contact a proximal end of the ridge 114. The guide surface 124 extends both in the up-down direction and in the conveyance direction. The ridge 114 is guided along the guide surface 124 in the up-down direction. The accommodating portion 121 further includes a plurality of, for example, two, second guides 123. The second guides 123 extend in the up-down direction and are disposed such that the second guides 123 sandwich the second projecting portions 108 of the case 71 therebetween in the scanning direction. Therefore, the second projecting portions 108 slide relative to the second guides 123 while being guided by the second guides 123 in the up-down direction. With this configuration, the cap-lift base 70 is supported by the accommodating portion 121 so as to be movable in the up-down direction. Although the accommodating portion 121 further includes a configuration for supporting the cap-lift base 70 and allowing the cap-lift base 70 to move in the up-down direction in addition to the above-described configuration, a detailed description for the other configuration will be omitted.

The bosses 112*a* and 112*b* aligned in the up-down direction are positioned between the first guides 122 in the conveyance direction and thus are restricted from moving in the conveyance direction. Therefore, the cap-lift base 70 including the first projecting portion 72 may be restricted from rotating on an axis extending in the scanning direction may be restricted.

Proximal ends of the first guides 122 are in contact with the ribs 113*a* and 113*b* while the proximal end of the ridge 114 is in contact with the guide surface 124. Therefore, in the first projecting portion 72, the portion having the ribs 113*a* and the portion having the ribs 113*b* are sandwiched between the respective first guides 122 and the guide surface 124 in the scanning direction, whereby the first projecting portion 72 is restricted from moving in the scanning direction. Therefore, this restriction further restrict the rotation of the cap-lift base 70 including the first projecting portion 72 on an axis extending in the conveyance direction.

Consequently, the cap-lift base 70 is restricted from rotating on an axis extending orthogonal to the up-down direction.

In the illustrative embodiment, while the bosses 112*a* and 112*b* are restricted from moving in the conveyance direction, the first projecting portion 72 and the second projecting portions 108 are also restricted from moving in the scanning direction. These restrictions further restricts the rotation of the cap-lift base 70 within the horizontal plane.

The base member 80 is attached to the guide rails 11 and 12 (refer to FIG. 1) and the right frame 14. Nevertheless, the members to which the base member 80 is attached are not limited to the specific examples. In one example, the base member 80 may be attached to at least one of the guide rails 11 and 12 and the frame 14. In another example, the base member 80 may be attached to a member supporting a frame from below (e.g., a member for storing a recording sheet P).

The accommodating portion 121 has a through hole 125 vertically below the tubular portion 105 of the cap-lift base 70. An ink foam 120 for absorbing ink is disposed below the base member 80 such that the ink foam 120 is positioned vertically below at least the through hole 125.

In the illustrative embodiment, for example, when the nozzle cap 36, the cap holder 50, and the cap-lift holder 60 tilt relative to the conveyance direction such that their downstream portions are located lower than their upstream portions in the conveyance direction, ink may spill on the cap holder 50 from the nozzle cap 36. In a case where ink spills from the nozzle cap 36, the spilt ink is received by the upper surface 51*a* of the bottom wall 51 of the cap holder 50. The ink received by the upper surface 51*a* then runs to the outlet 54 along a corner 55 of the bottom wall 51 and the sidewall 52 and is discharged downward through the outlet 54. The ink discharged through the outlet 54 is then received by the upper surface 65*a* of the ink receiving portion 65 of the cap-lift holder 60 and is further discharged downward through the outlet 67 and the internal space 66*a* of the tubular portion 66. The ink discharged therethrough is then received by the upper surface 104*a* of the ink receiving portion 104 of the cap-lift base 70 and is further discharged through the outlet 106 and the internal space 105*a* of the tubular portion 105. The ink further discharged therethrough arrives the ink foam 120 through the through hole 125 and is thus absorbed by the ink foam 120.

The base member 80 further includes a portion to which the switching device 33 is connected and a portion to which the suction pump 32 is connected, as well as the accommodating portion 121 for supporting the cap-lift base 70 and allowing the cap-lift base 70 to move in the up-down direction.

(Slide Cam)

The slide cam 90 extends along the conveyance direction. The slide cam 90 is configured to reciprocate along the conveyance direction by a drive mechanism (not depicted). The slide cam 90 is supported by a plurality of ribs disposed at an inner bottom surface which may constitute the accommodating portion 121 of the base member 80. The slide cam 90 is configured to slide relative to the plurality of ribs. The slide cam 90 has a plurality of, for example, two, guide grooves 131 corresponding to the respective protrusions 107*a* of the cap-lift base 70. The protrusions 107*a* are positioned in the respective guide grooves 131. Each of the guide grooves 131 has horizontal sections 132*a*, 132*b*, and 132*c* and inclined sections 133*a* and 133*b*.

The horizontal section 132*a* extends parallel to the conveyance direction. The horizontal section 132*b* extends parallel to the conveyance direction. The horizontal section 132*b* is located upstream of the horizontal section 132*a* in the conveyance direction and lower than the horizontal section 132*a*. The horizontal section 132*c* extends parallel to the conveyance direction. The horizontal section 132*c* is located upstream of the horizontal section 132*b* in the conveyance direction and lower than the horizontal section 132*b*. The inclined section 133*a* is located between the horizontal section 132*a* and the horizontal section 132*b* in the conveyance direction. The inclined section 133*a* is angled relative to the conveyance direction and extends diagonally upward and downstream in the conveyance direction from the horizontal section 132*b*. The inclined section 133*a* connects between the horizontal section 132*a* and the horizontal section 132*b*. The inclined section 133*b* is located between the horizontal section 132*b* and the horizontal section 132*c* in the conveyance direction. The inclined section 133*b* is angled relative to the conveyance direction and extends diagonally upward and downstream in the conveyance direction from the horizontal section 132*c*. The inclined section 133*b* connects between the horizontal section 132*b* and the horizontal section 132*c*.

In a state where the protrusion 107*a* is positioned in the horizontal section 132*a* (although only one of the protrusions 107*a* is depicted in the drawings, both of the protrusions 107*a* move simultaneously and are located at the same respective sections), the nozzle cap 36, the air exhaustion cap 37, the cap holder 50, the cap-lift holder 60, and the cap-lift base 70 are positioned at their respective highest positions within their respective movable ranges. When the nozzle cap 36 and the air exhaustion cap 37 are positioned at the respective highest positions after the carriage 3 is positioned at the maintenance position, the nozzle cap 36 intimately contacts the ink ejection surface 5*a* with the cap 36*a* covering the rightmost one of the nozzle rows 10 and the cap 36*b* covering the remainder of the nozzle rows 10. In this state, the air exhaustion cap 37 also covers the openings 26*a* of the air exhaustion channels 26. Hereinafter, the position of the nozzle cap 36 in this state is referred to as a capping position.

While the cap-lift holder 60 moves toward its highest position, the contact portion 64 (only one of the contact portion 64 is depicted in the drawings) of the cap-lift holder 60 comes into contact with the carriage 3. In response to this, the cap-lift holder 60 rotates relative to the cap-lift base 70 within the horizontal plane in accordance with the degree of tilting of the inkjet head 5. As a result, the nozzle cap 36 that rotates within the horizontal plane together with the cap-lift holder 60 is positioned in accordance with the degree of tilting of the inkjet head 5.

In this state, the carriage lock 111 of the cap-lift base 70 is also located at the highest position within its movable range, and the carriage lock 111 overlaps the carriage 3 in a vertical dimension. Therefore, in this state, the carriage lock 111 restricts the leftward movement of the carriage 3 in the scanning direction from the maintenance position.

Figure 12A:
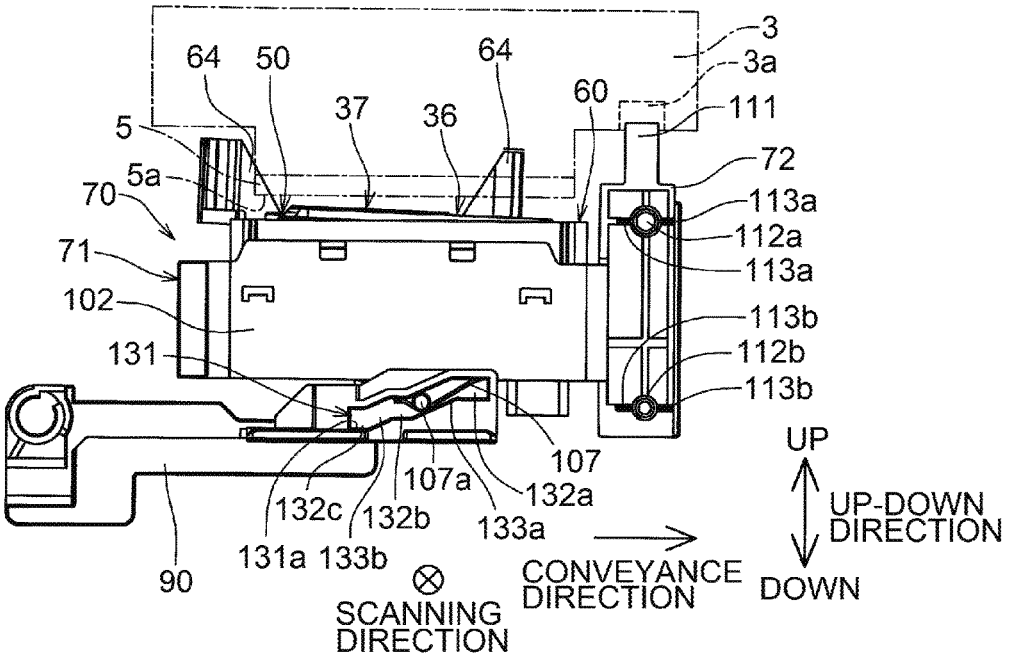
FIG. 12A is a left side view depicting the capping unit with the nozzle cap separated from an ink ejection surface in the illustrative embodiment according to one or more aspects of the disclosure, wherein the base member is omitted.

In a case where the slide cam 90 is moved upstream in the conveyance direction from the above state, the protrusion 107*a* moves from the horizontal section 132*a* to the inclined section 133*a* by sliding relative to an inner wall surface 131*a* defining the guide groove 131. Thus, as depicted in FIG. 12A, the nozzle cap 36, the air exhaustion cap 37, the cap holder 50, the cap-lift holder 60, and the cap-lift base 70 move downward and the nozzle cap 36 becomes separated from the ink ejection surface 5*a*. When the protrusion 107*a* reaches the horizontal section 132*b*, the nozzle cap 36 is located at a predetermined level in which the nozzle cap 36 is separated from the ink ejection surface 5*a*. Hereinafter, the position of the nozzle cap 36 in this state is referred to as an intermediate position.

Figure 12B:
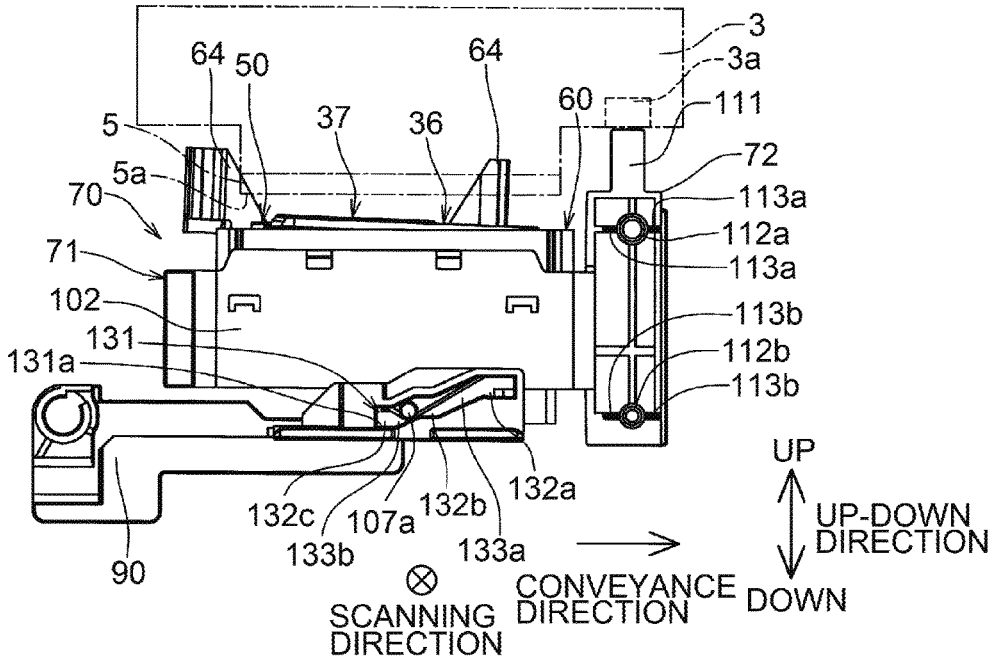
FIG. 12B is a left side view depicting the capping unit with the nozzle cap further separated from the ink ejection surface than the state of FIG. 12A in the illustrative embodiment according to one or more aspects of the disclosure, wherein the base member is omitted.

In a case where the slide cam 90 is moved further upstream in the conveyance direction, the protrusion 107*a* moves from the horizontal section 132*a* to the inclined section 133*b* by sliding relative to the inner wall surface 131*a* of the guide groove 131. Thus, as depicted in FIG. 12B, the nozzle cap 36, the air exhaustion cap 37, the cap holder 50, the cap-lift holder 60, and the cap-lift base 70 move further downward. When the protrusion 107*a* reaches the horizontal section 132*c*, the nozzle cap 36 is located at the lowest position within its movable range. Hereinafter, the position of the nozzle cap 36 in this state is referred to as a retracted position.

In a case where the slide cam 90 is moved downstream in the conveyance direction from the above state, the protrusion 107*a* moves from the horizontal section 132*c* to the horizontal section 132*a* via the inclined section 133*b*, the horizontal section 132*b*, and the inclined section 133*a* in this sequence by sliding relative to the inner wall surface 131*a* of the guide groove 131. Thus, the nozzle cap 36, the air exhaustion cap 37, the cap holder 50, the cap-lift holder 60, and the cap-lift base 70 move upward, that is, the nozzle cap 36 moves from the retracted position to the capping position via the intermediate position.

When the cap-lift base 70 moves upward, the carriage lock 111 also moves upward. When the nozzle cap 36 is located higher than a predetermined uncapping position between the intermediate position and the retracted position while the carriage lock 111 moves downward, the carriage lock 111 overlaps the carriage 3 in a vertical dimension to restrict the movement of the carriage 3 in the scanning direction. As depicted in FIG. 12B, when the nozzle cap 36 is located lower than the uncapping position while the carriage lock 111 moves downward, the carriage lock 111 does not overlap the carriage 3 in a vertical dimension. When the nozzle cap 36 is located at the uncapping position, the carriage lock 111 does not overlap the carriage 3 in a vertical dimension. That is, the restriction on the movement of the carriage 3 in the scanning direction by the carriage lock 111 is not released until the nozzle cap 36 arrives at the uncapping position.

As depicted in FIGS. 12A and 12B, in the state where the nozzle cap 36 is separated from the ink ejection surface 5*a*, the nozzle cap 36 and the cap holder 50 are tilted relative to the conveyance direction such that the downstream portions of the nozzle cap 36 and the cap holder 50 are located lower than the upstream portions of the nozzle cap 36 and the cap holder 50 in the conveyance direction (e.g., such that the downstream portions of the nozzle cap 36 and the cap holder 50 are separated farther from the ink ejection surface 5*a* than the upstream portions of the nozzle cap 36 and the cap holder 50). The cap-lift holder 60 is also tilted relative to the conveyance direction slightly. More specifically, if the cap-lift holder 60 is strongly restricted from tilting relative to the conveyance direction, the cap holder 60 might not be able to rotate smoothly relative to the cap-lift base 70 within the horizontal plane. Therefore, the tilting of the cap-lift holder 60 relative to the conveyance direction might not be strongly restricted, whereby the cap-lift holder 60 is allowed to be tilted relative to the conveyance direction slightly.

In response to the tilting of the cap-lift holder 60 relative to the conveyance direction, the cap-lift holder 60 and the cap-lift base 70 move relative to each other and the outlet 67 and the tubular portion 66 move in the conveyance direction relative to the ink receiving portion 104. In the illustrative embodiment, in both of the state where the nozzle cap 36 is in contact with the ink ejection surface 5*a* and the nozzle cap 36, the air exhaustion cap 37, the cap holder 50, and the cap-lift holder 60 are not tilted and the state where the nozzle cap 36 is separated from the ink ejection surface 5*a* and the nozzle cap 36, the air exhaustion cap 37, the cap holder 50, and the cap-lift holder 60 are tilted relative to the conveyance direction, the outlet 67 of the cap-lift holder 60 is always positioned vertically above the upper surface 104*a* of the ink receiving portion 104 of the case 71.

The switching device 33 is connected to the suction pump 32 via the tubes as well as the cap 36*a*, the cap 36*b*, and the air exhaustion cap 37. The switching device 33 is configured to switch a connection state between a state where a connection between the cap 36*a* and the suction pump 32 is established, a state where a connection between the cap 36*b* and the suction pump 32 is established, and a state where a connection between the air exhaustion cap 37 and the suction pump 32 is established. The wasted liquid tank 34 is also connected to the suction pump 32. In the printer 1, in a case where the suction pump 32 is driven by control of the controller 100 after an alternative of the cap 36*a* or the cap 36*b* is connected to the suction pump 32 while the nozzle cap 36 covers the nozzles 18, suction purge may be performed for discharging ink from the inkjet head 5 to the alternative of the cap 36*a* or the cap 36*b* via corresponding ones of the nozzles 18. In a case where the suction pump 32 is driven after the nozzle cap 36 is moved to the intermediate position subsequent to the suction purge, idle suction may be performed for discharging ink from the alternative one of the cap 36*a* or the cap 36*b*. In a case where the suction pump 32 is driven after the air exhaustion cap 37 is connected to the suction pump 32 while the nozzle cap 36 covers the nozzles 18, exhaust purge may be performed for exhausting air from the air exhaustion channel 26. The ink discharged by suction purge or by idle suction is stored in the wasted liquid tank 34.

In the illustrative embodiment, even when the positional relationship between the cap holder 50 and the cap-lift holder 60 changes due to the relative movement therebetween, the outlet 54 is always positioned vertically above the upper surface 65*a* of the ink receiving portion 65. Therefore, ink spilt on the cap holder 50 from the nozzle cap 36 and discharged through the outlet 54 may be surely received by the ink receiving portion 65. When the ink is discharged through the outlet 54, the outlet 54 is positioned vertically above the outlet 67. Therefore, the ink discharged to the ink receiving portion 65 through the outlet 54 is further discharged through the outlet 67 immediately and tends not to stay at the ink receiving portion 65. Thus, the ink may be discharged from the ink receiving portion 65 effectively.

In the illustrative embodiment, even when the relative positional relationship between the cap-lift holder 60 and the cap-lift base 70 changes by rotation of the cap-lift holder 60 within the horizontal plane relative to the cap-lift base 70, the outlet 67 is always positioned vertically above the upper surface 104*a* of the ink receiving portion 104. Therefore, ink discharged through the outlet 67 may be surely received by the ink receiving portion 104. When the ink discharged through the outlet 67, the ink receiving portion 104 is positioned vertically above the outlet 106. Therefore, the ink discharged to the ink receiving portion 104 through the outlet 67 is further discharged through the outlet 106 immediately and tends not to stay at the ink receiving portion 104. Thus, the ink may be discharged from the ink receiving portion 104 effectively.

In the illustrative embodiment, the cap holder 50 includes the downwardly-extending tubular portion 53 vertically below the outlet 54. The tubular portion 53 includes the projecting portion 53*b* that may be the right end portion thereof and extends downward farther than the other portion thereof. With this configuration, ink running into the tubular portion 53 from the outlet 54 may tend to gather at the projecting portion 53*b* and therefore to be discharged downward easily.

The tubular portion 53 is positioned further to the right than the partition wall 65*b* in the scanning direction and within the extension range of the upper surface 65*a* of the ink receiving portion 65. At least the lower end of the projecting portion 53*b* is located lower than the upper end of the partition wall 65*b*. That is, the projecting portion 53*b* overlaps the partition wall 65*b* in a vertical dimension. With this configuration, ink discharged downward along the projecting portion 53*b* may be surely received by the ink receiving portion 65 without running out of the ink receiving portion 65.

In the illustrative embodiment, the cap-lift holder 60 includes the downwardly-extending tubular portion 66 is positioned vertically below the outlet 67. The tubular portion 66 is positioned further to the right than the partition wall 104*b* in the scanning direction and within the extension range of the upper surface 104*a* of the ink receiving portion 104. The lower end of the tubular portion 66 is located lower than the upper end of the partition wall 104*b*. That is, the tubular portion 66 overlaps the partition wall 104*b* in a vertical dimension. With this configuration, ink discharged downward along the tubular portion 66 may be surely received by the ink receiving portion 104 without running out of the ink receiving portion 104.

In the illustrative embodiment, in both of the state where the nozzle cap 36 is in contact with the ink ejection surface 5*a* to cover the nozzles 18 and the state where the nozzle cap 36 is separated from the ink ejection surface 5*a* and the nozzle cap 36, the cap holder 50, and the cap-lift holder 60 are tilted relative to the conveyance direction, the outlet 54 is positioned vertically above the ink receiving portion 65 and the outlet 67 is positioned vertically above the ink receiving portion 104 as described above. Accordingly, irrespective of whether the nozzle cap 36, the cap holder 50, and the cap-lift holder 60 are tilted or not relative to the conveyance direction, ink spilt on the cap holder 50 from the nozzle cap 36 may be discharged downward through the outlet 54, the ink receiving portion 65, and the ink receiving portion 104.

In the illustrative embodiment, the cap holder 50 has the wall surfaces 54*a*. The wall surfaces 54*a* define the outlet 54 and three of the wall surfaces 54*a* are contiguous to the wall surface 52 in the up-down direction. With this configuration, ink spilt on the cap holder 50 from the nozzle cap 36 runs along the corner 55 mainly. Therefore, the ink spilt on the cap holder 50 from the nozzle cap 36 may be surely discharged through the outlet 54.

In a case where ink spills on the cap holder 50 from the nozzle cap 36, ink runs into a clearance between the nozzle cap 36 and the sidewall 52 of the cap holder 50 and is received by the upper surface 51*a* of the bottom wall 51. If the clearance between the nozzle cap 36 and an upper end of the sidewall 52 of the cap holder 50 is relatively small, the ink spilt from the nozzle cap 36 might not run into the clearance and thus may run to the outside of the cap holder 50.

In contrast to the illustrative embodiment, if the wall surface 52*a* of the sidewall 52 extends parallel to the up-down direction, the cap holder 50 needs to be increased in size both in the scanning direction and in the conveyance direction in order to increase the size of the clearance.

Therefore, in the illustrative embodiment, the upper end portion of the inner wall surface 52*a* has the tapered portion 52*a*1 that is inclined downward toward the center of the cap holder 50 from the upper end of the inner wall surface 52*a*. This configuration may enable to make the clearance between the nozzle cap 36 and the upper end of the sidewall 52 larger without increasing the size of the cap holder 50. Consequently, ink spilt from the nozzle cap 36 may be surely directed to the clearance. In order for the ink spilt from the nozzle cap 36 to be surely directed to the clearance, it is preferable that the clearance be 1 mm or greater.

In the illustrative embodiment, when the nozzle cap 36 is separated from the ink ejection surface 5*a*, the nozzle cap 36, the cap holder 50, and the cap-lift holder 60 are tilted relative to the conveyance direction such that their downstream portions are located lower than their upstream portions in the conveyance direction. Therefore, in this state, ink tends to spill on the cap holder 50 from the nozzle cap 36 and the ink spilt on the cap holder 50 from the nozzle cap 36 tends to run toward its downstream portion that is located lower than its upstream portion in the conveyance direction. In the illustrative embodiment, the cap holder 50 has the outlet 54 at the downstream end portion thereof in the conveyance direction. With this configuration, the ink spilt on the cap holder 50 from the nozzle cap 36 may be discharged through the outlet 54 effectively.

In the state where the nozzle cap 36 is tilted such that its downstream portion is located lower than its upstream portion in the conveyance direction, the upstream end portion of the nozzle cap 36 in the conveyance direction is located closest to the ink ejection surface 5*a*. Therefore, when the nozzle cap 36 is separated from the ink ejection surface 5*a*, an ink bridge may occur between the upstream end portion of the nozzle cap 36 in the conveyance direction and the ink ejection surface 5*a* by surface tension of ink. In the illustrative embodiment, the caps 36*a* and 36*b* have the suction ports 36*c* and 36*d*, respectively, at the upstream end portions thereof in the conveyance direction. This configuration may enable effective discharge of ink remaining in the caps 36*a* and 36*b* therefrom during idle suction.

In the illustrative embodiment, the cap holder 50 has the outlet 54 in the particular portion that is to be located lower than the other portion of the tilting cap holder 50 when the nozzle cap 36 is tilted with its upstream end portion having the suction ports 36*c* and 36*d* being located at the highest level in the conveyance direction. Therefore, this configuration might not require a special operation for tilting the cap holder 50 to make the downstream end portion having the outlet 54 located at the lowest level in the conveyance direction. Accordingly, ink remaining in the cap holder 50 may be discharged through the outlet 54 effectively by performing operations similar to known operations such that idle suction is performed subsequent to suction purge.

In the illustrative embodiment, pigment ink is used for both black and color inks, and the black ink has a higher pigment density than the color inks. Thus, the black ink tends to solidify easier than the color inks. In the illustrative embodiment, the outlet 54 is provided at the right end portion of the cap holder 50. That is, in a state where the nozzle cap 36 covers the nozzles 18, the outlet 54 of the cap holder 50 is positioned closer to the rightmost one of the nozzle row 10 than the remainder of the nozzle rows 10 in the scanning direction.

Black ink in the cap 36*a* may tend to spill onto the right portion of the cap holder 50 and color inks in the cap 36*b* may tend to spill onto the left portion of the cap holder 50. Therefore, the black ink spilt on the cap holder 50 may run to the outlet 54 for a shorter distance than the color inks, and thus the configuration may enable the easy-to-solidify black ink to run to the outlet 54 easily before the black ink solidifies. The color inks spilt on the cap holder 50 may run to the outlet 54 through the area on which the black ink has spilt. When the color inks run over the black ink, the easy-to-solidify black ink mixes with the hard-to-solidify color inks, thereby reducing a risk of solidification of the black ink and enabling the black ink to be surely discharged through the outlet 54.

In the illustrative embodiment, the nozzle cap 36 and the air exhaustion cap 37 are disposed side by side in the scanning direction. The air exhaustion cap 37 is shorter in length than the nozzle cap 36 in the conveyance direction. The upstream end of the nozzle cap 36 and the upstream end of the air exhaustion cap 37 are substantially aligned with each other with respect to the conveyance direction. This configuration may provide a space to the right of the nozzle cap 36 in the scanning direction and downstream of the air exhaustion cap 37 in the conveyance direction. In the illustrative embodiment, the outlet 54 of the cap holder 50 is positioned in the space. That is, the space may be used effectively.

In contrast to the illustrative embodiment, it is conceivable that an air communication port that may be configured to be closed and opened by the switching device 33 may be provided in each of the caps 36*a* and 36*b* in addition to the suction ports 36*c* and 36*d*. In this case, subsequent to suction purge, while an alternative of the cap 36*a* or the cap 36*b* is in communication with air via a corresponding one of the air communication ports with the nozzle cap 36 contacting with the ink ejection surface 5*a*, idle suction may be performed by driving the suction pump 32. Nevertheless, in the illustrative embodiment, pigment ink having higher optical density ("OD") is used for ink to be ejected from the nozzles 18. Because of this, when ink enters in a channel contiguous to the air communication port, the ink may solidify in a short time and may block air communication of the caps 36*a* and 36*b* via the air communication ports. Therefore, in the illustrative embodiment, in idle suction subsequent to suction purge, the suction pump 32 is driven after the nozzle cap 36 is separated from the ink ejection surface 5*a*.

Nevertheless, in this case, when the nozzle cap 36 is tilted relative to the conveyance direction in connection with separation of the nozzle cap 36 from the ink ejection surface 5*a*, ink may tend to spill from the nozzle cap 36. Recently, in light of speeding up of printing, as a general trend, the number of nozzles 18 constituting each nozzle row 10 is increased and the inkjet head 5 is increased in size in the conveyance direction. In this case, however, the nozzle cap 36 may also be increased in size and the amount of ink held by each of the caps 36*a* and 36*b* may also be increased. Therefore, when the nozzle cap 36 is tilted relative to the conveyance direction in connection with separation of the nozzle cap 36 from the ink ejection surface 5*a*, this configuration may tend to cause spill of ink from the caps 36*a* and 36*b*.

In order to solve such a problem, it is conceivable that an ink foam may be disposed in the vicinity of the nozzle cap 36. In this case, if an amount of ink spilling from the caps 36*a* and 36*b* is relatively large, an ink foam may need to have a large body and a relatively large space may be required for placing such an ink foam. Nevertheless, various components are positioned in the vicinity of the nozzle cap 36 and therefore there is no sufficient space for placing such a relatively large ink foam.

Therefore, in the illustrative embodiment, the ink foam 120 is disposed below the base member 80, and ink spilt from the nozzle cap 36 needs to be transferred to the ink foam 120 from the nozzle cap 36. Further, the slide cam 90 is disposed between the nozzle cap 36 and the ink foam 120 in the up-down direction. In this configuration, if ink adheres to a driving portion of the slide cam 90 during transfer of the spilt ink to the ink foam 120 and solidifies at the driving portion, the ink solidification may cause the slide cam 90 not to move.

In order to avoid an occurrence of such a problem, in the illustrative embodiment, the outlet 54, the ink receiving portions 65 and 104, and the through hole 125 are provided for directing, to the ink foam 120, ink spilt on the cap holder 50 from the nozzle cap 36 and are disposed so as not to be positioned vertically above the slide cam 90. Therefore, this configuration may reduce a risk of adhesion of ink spilt from the nozzle cap 36, to the slide cam 90.

In the illustrative embodiment, the cap holder 50 for tilting the nozzle cap 36, the cap-lift holder 60 for rotating the nozzle cap 36 within the horizontal plane, and the cap-lift base 70 for moving the nozzle cap 36 in the up-down direction are separate members, and are configured to move relative to each other. Therefore, the outlet 54 of the cap holder 50, the ink receiving portion 65 of the cap-lift holder 60, and the ink receiving portion 104 of the cap-lift base 70 are provided at respective appropriate locations.

In the illustrative embodiment, the printer 1 corresponds to a liquid ejection device. The inkjet head 5 corresponds to a liquid ejection head. The nozzle cap 36 corresponds to each of a cap and a first cap. The air exhaustion cap 37 corresponds to a second cap. The nozzles 18 constituting the left three of the nozzle rows 10 correspond to first nozzles. The nozzles 18 constituting the rightmost one of the nozzle rows 10 correspond to second nozzles.

In the illustrative embodiment, in the relationship between the cap holder 50 and the cap-lift holder 60, the cap holder 50 corresponds to a first liquid receiver. The cap-lift holder 60 corresponds to a second liquid receiver. The upper surface 51*a* of the bottom wall 51 corresponds to a first receiving surface. The upper surface 65*a* of the ink receiving portion 65 corresponds to a second receiving surface. The outlet 54 corresponds to an outlet. The tubular portion 53 corresponds to an extended portion. A combination of the outlet 67 and the internal space 66*a* of the tubular portion 66 corresponds to a second discharge aperture.

In the relationship between the cap-lift holder 60 and the cap-lift base 70, the cap-lift holder 60 corresponds to the first liquid receiver. The cap-lift base 70 corresponds to the second liquid receiver. The upper surface 51*a* of the ink receiving portion 65 corresponds to the first receiving surface. The upper surface 104*a* of the ink receiving portion 104 corresponds to the second receiving surface. The tubular portion 66 corresponds to the extend portion. A combination of the outlet 106 and the internal space 105*a* of the tubular portion 105 corresponds to the second discharge aperture. Each of the through holes 103 corresponds to a restricting unit and an engagement portion. Each of the hooks 68 corresponds to an engaged portion.

The up-down direction corresponds to a first direction. The conveyance direction corresponds to a second direction. The scanning direction corresponds to a third direction.

While the disclosure has been described in detail with reference to the specific embodiment thereof, this is merely an example, and various changes, arrangements and modifications may be applied therein without departing from the spirit and scope of the disclosure. Hereinafter, various alternative embodiments will be described.

In other embodiments, for example, when the cap holder 50 and the cap-lift holder 60 move relative to each other, the outlet 54 might not be positioned vertically above the outlet 67 within the extension range of the upper surface 65*a* of the ink receiving portion 65. In other embodiments, for example, when the cap holder 50 and the cap-lift holder 60 move relative to each other, the outlet 54 might not be positioned above the outlet 67 within the extension range of the upper surface 65*a* of the ink receiving portion 65 irrespective of their positional relationship. In each of these cases, ink discharged through the outlet 54 may be also received by the upper surface 65*a* and further run into the outlet 67.

In other embodiments, for example, when the cap-lift holder 60 and the cap-lift base 70 move relative to each other, the outlet 67 might not be positioned vertically above the outlet 106 within the extension range of the upper surface 104*a* of the ink receiving portion 104. In other embodiments, for example, when the cap-lift holder 60 and the cap-lift base 70 move relative to each other, the outlet 67 might not be positioned vertically above the outlet 106 within the extension range of the upper surface 104*a* of the ink receiving portion 104 irrespective of their positional relationship.

In the illustrative embodiment, the lower end of the projecting portion 53*b* of the tubular portion 53 is located lower than the upper end of the partition wall 65*b* of the ink receiving portion 65. Nevertheless, in other embodiments, for example, the lower end of the projecting portion 53*b* of the tubular portion 53 may be located higher than or equal to the upper end of the partition wall 65*b* of the ink receiving portion 65. In this case, unless external force is applied to the printer 1 while ink is discharged through the tubular portion 53, the ink discharged therethrough may also be received by the upper surface 65*a* of the ink receiving portion 65. Similarly, the lower end of the tubular portion 66 may be located higher than or equal to the upper end of the partition wall 104*b* of the ink receiving portion 104.

In the illustrative embodiment, while the tubular portion 53 includes the projecting portion 53*b*, the tubular portion 66 has substantially the same length in the up-down direction. Nevertheless, in other embodiments, for example, the tubular portion 53 might not necessarily include the projecting portion 53*b* and may have substantially the same length in the up-down direction. In other embodiments, for example, the tubular portion 66 may include a projecting portion extending downward farther than the other portion thereof.

In the illustrative embodiment, the cap holder 50 includes the downwardly-extending tubular portion 53 vertically below the outlet 54. Nevertheless, in other embodiments, for example, the cap holder 50 might not necessarily include the tubular portion 53. Similarly, the cap-lift holder 60 might not necessarily include the tubular portion 66 vertically below the outlet 67 of the ink receiving portion 65. The cap-lift base 70 might not necessarily include the tubular portion 105 vertically below the outlet 106 of the ink receiving portion 104.

In other embodiments, for example, the outlet 54 may be defined in the central portion of the bottom wall 51.

In the illustrative embodiment, the cap holder 50 and the cap-lift holder 60 are separate members. Nevertheless, in other embodiments, for example, the cap holder 50 and the cap-lift holder 60 may be inseparable from each other and may constitute a one-piece component. In this case, an ink receiving portion for receiving ink spilt from the nozzle cap 36 of the one-piece component corresponds to the first liquid receiver, and the ink receiving portion 104 of the cap-lift base 70 corresponds to the second liquid receiver.

In the illustrative embodiment, when the nozzle cap 36 is separated from the ink ejection surface 5*a*, the downstream portions of the nozzle cap 36 and the cap holder 50 are located lower than the upstream portions of the nozzle cap 36 and the cap holder 50 in the conveyance direction. Nevertheless, in other embodiments, for example, the nozzle cap 36 and the cap holder 50 may be joined by a different manner than the manner of the illustrative embodiment. More specifically, for example, while the nozzle cap 36 is tilted such that its downstream portion is located lower than its upstream portion in the conveying direction, the cap holder 50 may be tilted such that its upstream portion is located lower than its downstream portion in the conveying direction. In this case, the outlet 54 may be defined in the upstream end portion of the cap holder 50 in the conveyance direction. With this configuration, ink spilt on the cap holder 50 from the nozzle cap 36 may be discharged through the outlet 54 effectively.

In the illustrative embodiment, the cap holder 50 has the outlet 54 in its one end portion that is to be located lower than its other end portion in the conveyance direction when the cap holder 50 is tilted relative to the conveyance direction. Nevertheless, in other embodiments, for example, the cap holder 50 may have the outlet 54 in the other end portion that is to be located higher than the one end portion in the conveyance direction when the cap holder 50 is tilted relative to the conveyance direction or in the central portion of the cap holder 50.

In the illustrative embodiment, the nozzle cap 36 has the suction ports 36*c* and 36*d* in its one end portion that is to be located higher than its other end portion in the conveyance direction when the nozzle cap 36 is tilted relative to the conveyance direction. Nevertheless, in other embodiments, for example, the nozzle cap 36 may have the suction ports 36*c* and 36*d* in the other end portion that is to be located lower than the one end portion in the conveyance direction when the nozzle cap 36 is tilted relative to the conveyance direction or in the middle portion of the nozzle cap 36 in the conveyance direction.

In the illustrative embodiment, when the nozzle cap 36 is separated from the ink ejection surface 5*a*, the nozzle cap 36 and the cap holder 50 is configured to tilt relative to the conveyance direction. Nevertheless, in other embodiments, for example, the nozzle cap 36 and the cap holder 50 may be configured not to tilt relative to the conveyance direction even when the nozzle cap 36 is separated from the ink ejection surface 5*a*.

In the illustrative embodiment, the air exhaustion cap 37 having a length shorter than the nozzle cap 36 in the conveyance direction is disposed to the right of the nozzle cap 36. Nevertheless, in other embodiments, for example, a first cap may be used for covering the left three of the nozzle rows 10 other than the rightmost one of the nozzle rows 10 and a second cap may be used for covering the rightmost one of the nozzle rows 10. The first and second caps may be disposed side by side in the scanning direction, and the second cap may have a length in the conveyance direction shorter than the first cap. In this case, also, a space may be provided to the right of the first cap in the scanning direction and downstream of the second cap in the conveyance direction, and the outlet 54 may be positioned in the space. Therefore, the space may be used effectively.

In the illustrative embodiment, the nozzle cap 36 and the air exhaustion cap 37 are disposed side by side in the scanning direction. Nevertheless, in other embodiments, for example, the sub-tank 4 might not have air exhaustion channels and the capping unit 31 might not include the air exhaustion cap 37.

In the illustrative embodiment, the nozzle row 10 including the nozzles 18 through which easy-to-solidify black ink is ejected is disposed to the right of the other nozzle rows 10 each including the nozzles 18 through which hard-to-solidify color ink is ejected. In response to this configuration, the cap holder 50 has the outlet 54 in the extended portion that is disposed at the downstream end portion in the conveyance direction and that extends further to the right than the other portion of the cap holder 50 from the right end of the downstream end portion in the scanning direction. Nevertheless, the location of the outlet 54 is not limited to the specific example.

Figure 13A:
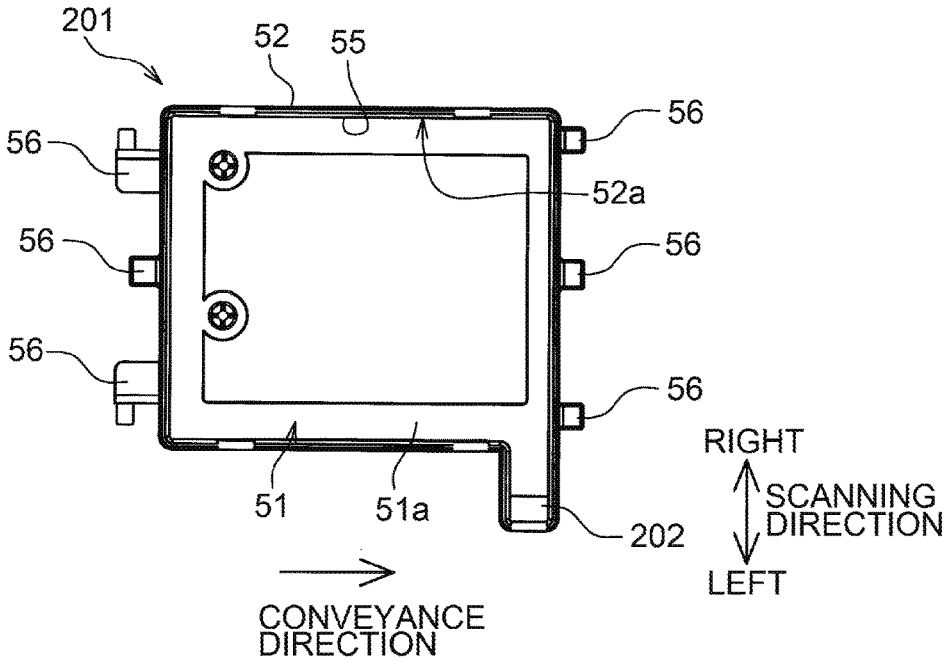
FIG. 13A is a top plan view depicting a cap holder in a first variation according to the illustrative embodiment according to one or more aspects of the disclosure.
Figure 13B:
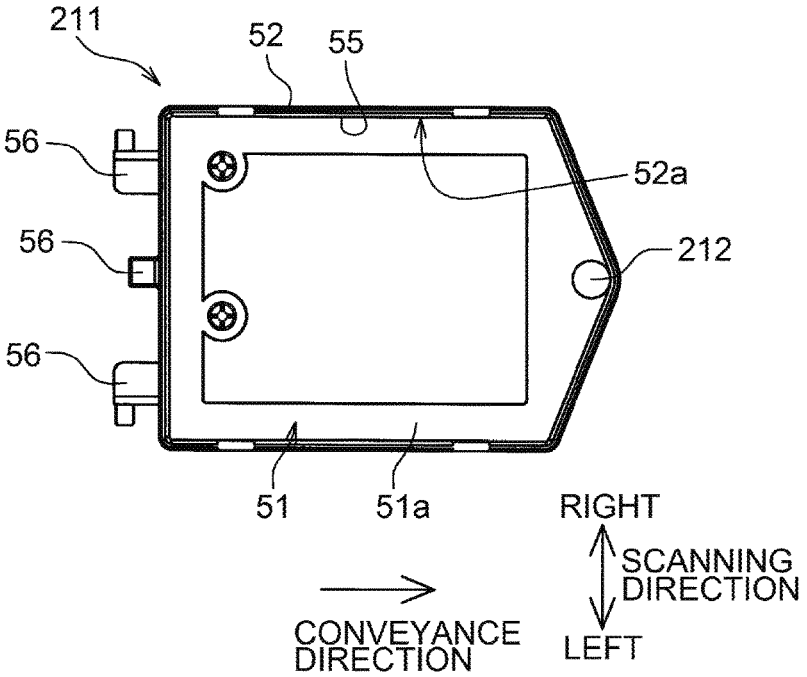
FIG. 13B is a top plan view depicting a cap holder in a second variation according to the illustrative embodiment according to one or more aspects of the disclosure.

In a first variation, for example, as depicted in FIG. 13A, a cap holder 201 has an outlet 202 in an extended portion that is disposed at a downstream end portion in the conveyance direction and that extends further to the left than the other portion of the cap holder 201 from a left end of the downstream end portion in the scanning direction. In a second variation, for example, as depicted in FIG. 13B, a cap holder 211 has an outlet 212 in its downstream end portion in the conveyance direction. The outlet 212 is defined in a middle portion of the downstream portion in the scanning direction. In FIG. 13B, for simplicity purpose, the downstream protrusions 56 in the conveyance direction are omitted from the drawing.

In both of the first and second variations, the cap holders 201 and 211 have the respective outlets 202 and 212 in their end portions that are to be located lower than their other end portion in the conveyance direction when each of the cap holders 201 and 211 is tilted relative to the conveyance direction. Therefore, ink spilt on the cap holders 201 and 211 from the respective nozzle caps 36 may be discharged effectively via the respective outlets 202 and 212.

In the illustrative embodiment, pigment ink is used for both of the black ink to be ejected from the nozzles 18 constituting the rightmost one of the nozzle rows 10 and the color inks to be ejected from the nozzles 18 constituting the remainder of the nozzle rows 10, and the black ink tends to solidify easier than the color inks since the pigment density of the black ink is higher than the pigment density of the color inks. Nevertheless, in other embodiments, for example, pigment ink may be used for the black ink and dye ink may be used for the color inks. In this case, also, the black ink may tend to solidify easier than the color inks. In still other embodiments, for example, the black ink may have an ink composition different from the color inks and the black ink may tend to solidify easier than the color inks due to its ink composition.

The black ink might not necessarily tend to solidify easier than the color inks. In one example, the degree of how easily ink solidifies may be substantially the same between the black ink and the color inks. In another example, the black ink may tend to solidify harder than the color inks.

In the illustrative embodiment, the inkjet head 5 includes the nozzles 18 for black ink that constitute the rightmost one of the nozzle rows 10 and the nozzles 18 for color inks that constitute the remainder of the nozzle rows 10. Nevertheless, the configuration of the inkjet head 5 is not limited to the specific example. In one example, an inkjet head may eject ink of a single color.

Figure 14:
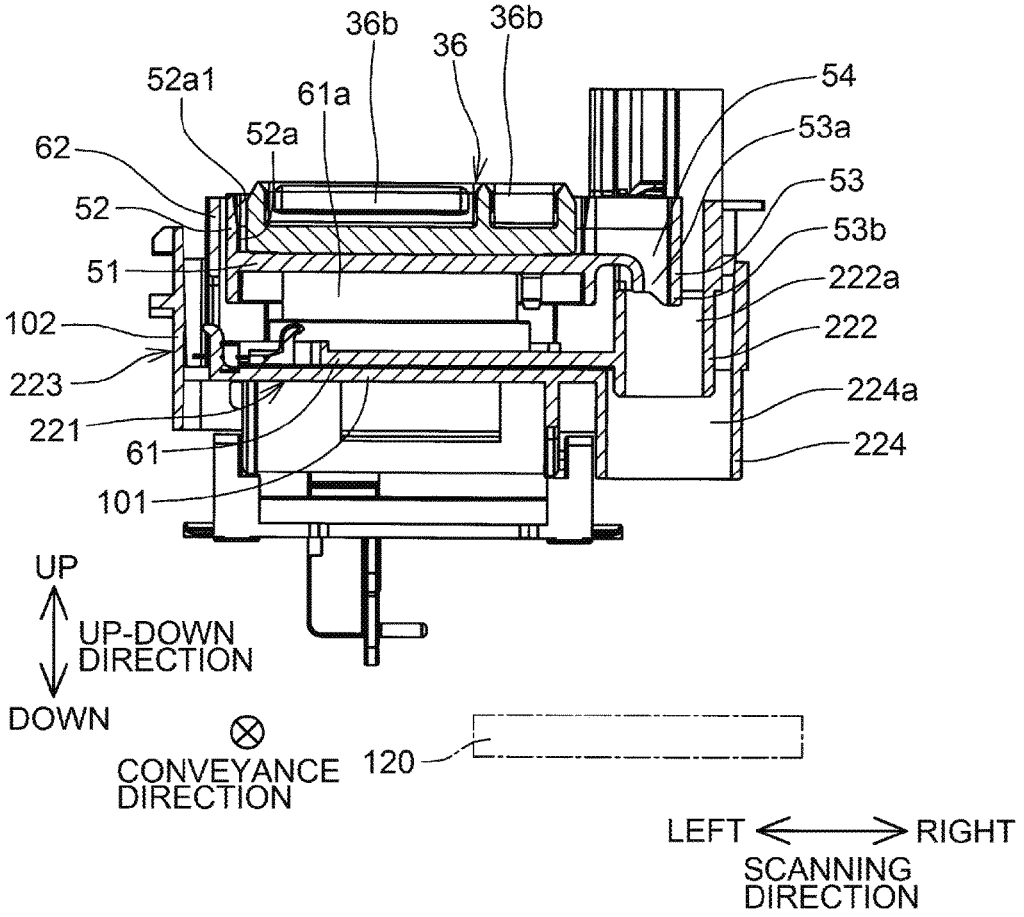
FIG. 14 is a sectional view depicting a capping unit in a third variation according to the illustrative embodiment according to one or more aspects of the disclosure, wherein a base member is omitted.

In the illustrative embodiment, the cap-lift holder 60 includes the ink receiving portion 65 having the upper surface 65*a* for receiving ink, and the cap-lift base 70 includes the ink receiving portion 104 having the upper surface 104*a* for receiving ink. Nevertheless, in a third variation, for example, as depicted in FIG. 14, a cap-lift holder 221 includes a tubular portion 222. The tubular portion 222 is positioned vertically below the outlet 54 and extends in the up-down direction. The tubular portion 222 has an internal space that may be a through hole 222*a* penetrating the cap-lift holder 221 in the up-down direction. A cap-lift base 223 includes a tubular portion 224. The tubular portion 224 is positioned vertically below the tubular portion 222 and extends in the up-down direction. The tubular portion 224 has an internal space that may be a through hole 224*a* penetrating the cap-lift base 223 in the up-down direction.

In the third variation, even when the positional relationship between the cap holder 50, the cap-lift holder 221, and the cap-lift base 223 changes due to relative movement between the cap holder 50 and the cap-lift holder 221 in the horizontal direction and rotation of the cap-lift holder 221 within the horizontal plane relative to the cap-lift base 223, the outlet 54, the tubular portion 53, the through hole 222*a* of the tubular portion 222, and the through hole 224*a* of the tubular portion 224 are aligned with each other vertically (i.e., overlap each other in a horizontal dimension). That is, the relative movement between the cap-lift holder 221 and the cap-lift base 223 is restricted within the overlapping range in which the outlet 54, the tubular portion 53, the through hole 222*a*, and the through hole 224*a* are positioned vertically one above another. With this configuration, ink discharged from the outlet 54 may be discharged to below the cap-lift base 223 through the through holes 222*a* and 224*a* and thus may be absorbed by the ink foam 120. In the third variation, each of the tubular portions 222 and 224 corresponds to the second liquid receiver, and each of the through holes 222*a* and 224*a* corresponds to the second discharge aperture.

In the illustrative embodiment, the upper end portion of the inner wall surface 52*a* of the sidewall 52 of the cap holder 50 includes the tapered portion 52*a*1 that is inclined downward toward the center of the cap holder 50 from the upper end of the sidewall 52. Nevertheless, in other embodiments, for example, if a sufficient clearance can be ensured between the upper end of the wall surface 52*a* of the sidewall 52 and the nozzle cap 36, the wall surface 52*a* of the sidewall 52 may extend parallel to the up-down direction.

In the illustrative embodiment, the cap holder 50 has the outlet 54 in the bottom wall 51. Nevertheless, in other embodiments, for example, the cap holder 50 may have such an outlet in the sidewall 52. Similarly, the cap holder 50 may have an outlet of the ink receiving portion 65 in the partition wall 65*b* and the cap-lift base 70 may have an outlet of the ink receiving portion 104 in the partition wall 104*b*.

In the illustrative embodiment, the nozzle cap 36, the cap holder 50, the cap-lift holder 60, and the cap-lift base 70 move along the up-down direction. Nevertheless, in other embodiments, for example, the nozzle cap 36, the cap holder 50, the cap-lift holder 60, and the cap-lift base 70 may move along another direction that may extend orthogonal to the liquid ejection surface and may be angled relative to the up-down direction. In this case, the other direction corresponds to the first direction.

In the illustrative embodiment, the cap holder 50 has the protrusions 56 and the cap-lift holder 60 has the engagement portions 63. Nevertheless, in other embodiments, for example, a cap holder may have engagement portions and a cap-lift holder may have protrusions.

In the illustrative embodiment, the nozzle cap 36 is configured to contact the ink ejection surface 5*a*. Nevertheless, in other embodiments, for example, the carriage 3 may have an opening for exposing the ink ejection surface 5*a* therethrough, and may further have a contact surface around the opening. The nozzle cap 36 may be configured to contact the contact surface of the carriage 3 to cover the nozzles 18. In another example, a contact surface to which the nozzle cap 36 contacts may be provided at edges of the ink ejection surface 5*a* of the inkjet head 5. In these examples, the ink ejection surface 5*a* or the contact surface corresponds to a lower surface.

The disclosure has been applied to an inkjet printer that performs printing by ejecting ink from nozzles. Nevertheless, application of the disclosure is not limited to the inkjet printer. The disclosure may be applied to other liquid ejection devices that eject liquid other than ink, other than the inkjet printer. For instance, the disclosure may be applied to systems that deposit liquid onto a substrate where the liquid later solidifies into solid form. An example may include printed circuit board manufacturing techniques where a moving carriage deposits line traces.

What is claimed is:

1. A liquid ejection device comprising:

an ejection head including a nozzle;

a cap having a top side proximate the ejection head, the cap configured to cover the nozzle;

a first liquid receiver including a first receiving surface positioned under the top side of the cap and a discharge portion connected to the first receiving surface, the discharge portion extending in a direction intersecting the first receiving surface; and a second liquid receiver including a second receiving surface positioned under the discharge portion, the second receiving surface configured to receive liquid discharged through the discharge portion, wherein one of the first liquid receiver and the second liquid receiver has an engagement portion, and the other of the first liquid receiver and the second liquid receiver has an engaged portion, and wherein play between the engagement portion and the engaged portion in a direction parallel to the second receiving surface is smaller than a distance between both ends of the second receiving surface in the direction parallel to the second receiving surface.

2. The liquid ejection device of claim 1, wherein the first liquid receiver supports the cap, and wherein the first receiving surface is positioned vertically below the cap and extends outside of the cap in the direction parallel to the second receiving surface.

3. The liquid ejection device of claim 1, wherein the first receiving surface is positioned vertically below the cap and extends outside of the cap in the direction parallel to the second receiving surface, wherein the first receiving surface has a first discharge aperture formed thereon as the discharge portion, and wherein the first liquid receiver has an extend portion extending from a second side of the first liquid receiver opposite the top side, the extend portion being connected to an inner surface of the first discharge aperture.

4. The liquid ejection device of claim 1, wherein the second liquid receiver includes a second discharge aperture, and wherein the discharge portion is positioned vertically above the second discharge aperture.

5. The liquid ejection device of claim 1, wherein the ejection head includes a lower surface including an ejection surface on which the nozzle is formed, the liquid ejection device further comprising:

a movement mechanism configured to move at least one of the cap and the ejection head in a first direction intersecting the lower surface to contact the cap to the lower surface or to separate the cap from the lower surface, wherein the first liquid receiver includes a first receive portion being one side of a second direction parallel to the lower surface, a second receive portion being the other side of the second direction, wherein the discharge portion is provided at the first receive portion, and wherein, in a state that the cap is separated from the lower surface, the first liquid receiver is inclined such that the first receive portion is positioned lower than the second receive portion.

6. The liquid ejection device of claim 5, wherein the cap includes, a first cap portion being one side of the second direction, a second cap portion being the other side of the second direction and a discharge hole provided at the second cap portion, and wherein, in a state that the cap is separated from the lower surface, the cap is inclined such that the first cap portion is positioned lower than the second cap portion.

7. The liquid ejection device of claim 5, wherein the ejection head is configured to eject first liquid and second liquid which solidifies easier than the first liquid, wherein the ejection head includes:

a first nozzle array including a plurality of the nozzles arranged in the second direction, and a second nozzle array including the plurality of nozzles arranged in the second direction, the second nozzle array arranged with the first nozzle array in a third direction parallel to the lower surface and orthogonal to the second direction, wherein the first liquid receiver includes a first opposite portion opposed to the first nozzle array and a second opposite portion opposed to the second nozzle array, and wherein the discharge portion is provided at a position being nearer the second opposite portion than the first opposite portion.

8. The liquid ejection device of claim 7, wherein the first liquid and the second liquid are a pigment ink, and wherein the second liquid has higher pigment density than the first liquid.

9. The liquid ejection device of claim 5, further comprising:

a second cap arranged with the cap in a third direction orthogonal to the second direction, the second cap being shorter than the cap in the second direction, wherein the discharge portion is arranged with the second cap in the second direction and is arranged with the cap in the third direction.

10. The liquid ejection device of claim 9, further comprising:

a supply channel configured to supply liquid with the ejection head; and a discharge channel diverged from the supply channel, the discharge channel including a tip on which an opening is formed, wherein the second cap is configured to cover the opening.

11. The liquid ejection device of claim 5, wherein the movement mechanism includes a cam configured to make the cap and the first liquid receiver move in the first direction, and wherein the discharge portion is arranged in a position to deviate from the cam in the second direction.

12. The liquid ejection device of claim 5, further comprising:

a pump connected to the cap; and a controller configured to:

control the movement mechanism to contact the cap to the lower surface, and control the pump to perform a purge process for discharging liquid from the ejection head; and after the purge process, control the movement mechanism to separate the cap from the lower surface, and control the pump to perform an idle suction process for discharging the liquid from the cap without discharging liquid from the ejection head.

13. A liquid ejection device comprising:

an ejection head including a nozzle;

a cap having a top side proximate the ejection head, the cap configured to cover the nozzle;

a first liquid receiver that supports the cap and includes a first receiving surface positioned under the top side of the cap and a discharge portion connected to the first receiving surface, the discharge portion extending in a direction intersecting the first receiving surface; and a second liquid receiver including a second receiving surface positioned under the discharge portion, a carriage having the ejection head mounted thereon, the carriage configured to reciprocate in a scanning direction orthogonal to the direction intersecting the first receiving surface, wherein one of the first liquid receiver and the second liquid receiver has an engagement portion, and the other of the first liquid receiver and the second liquid receiver has an engaged portion, wherein play between the engagement portion and the engaged portion in a direction parallel to the second receiving surface is smaller than a distance between both ends of the second receiving surface in the direction parallel to the second receiving surface, wherein the first receiving surface is positioned vertically below the cap and extends outside of the cap in the direction parallel to the second receiving surface, and wherein the first liquid receiver has a contact portion positioned higher than the top side of the cap, the contact portion being configured to contact the carriage.

14. A liquid ejection device comprising:

an ejection head including a nozzle;

a cap having a top side proximate the ejection head, the cap configured to cover the nozzle;

a first liquid receiver including a first receiving surface positioned under the top side of the cap and a discharge portion connected to the first receiving surface, the discharge portion extending in a direction intersecting the first receiving surface; and a second liquid receiver including a second receiving surface positioned under the discharge portion, wherein one of the first liquid receiver and the second liquid receiver has an engagement portion, and the other of the first liquid receiver and the second liquid receiver has an engaged portion, wherein play between the engagement portion and the engaged portion in a direction parallel to the second receiving surface is smaller than a distance between both ends of the second receiving surface in the direction parallel to the second receiving surface, wherein the first receiving surface is positioned vertically below the cap and extends outside of the cap in the direction parallel to the second receiving surface, wherein the first receiving surface has a first discharge aperture formed thereon as the discharge portion, wherein the first liquid receiver has an extend portion extending from a second side of the first liquid receiver opposite the top side, the extend portion being connected to an inner surface of the first discharge aperture, and wherein the extend portion has a tip end inclined with respect to the second receiving surface.

15. The liquid ejection device of claim 14, wherein the second liquid receiver includes a surrounding wall protruding from an edge of the second receiving surface, and wherein the tip end of the extend portion is positioned in an inside of the surrounding wall and is positioned lower than a tip end of the surrounding wall.

16. A liquid ejection device comprising:

an ejection head including a nozzle;

a cap having a top side proximate the ejection head, the cap configured to cover the nozzle;

a first liquid receiver including a first receiving surface positioned under the top side of the cap and a discharge portion connected to the first receiving surface, the discharge portion extending in a direction intersecting the first receiving surface; and a second liquid receiver including a second receiving surface positioned under the discharge portion, wherein one of the first liquid receiver and the second liquid receiver has an engagement portion, and the other of the first liquid receiver and the second liquid receiver has an engaged portion, wherein play between the engagement portion and the engaged portion in a direction parallel to the second receiving surface is smaller than a distance between both ends of the second receiving surface in the direction parallel to the second receiving surface, wherein the first liquid receiver includes four inner walls defining the discharge portion, wherein the first liquid receiver includes a sidewall protruding from an edge of the first receiving surface, and wherein at least one of the four inner walls connects to the sidewall in the direction intersecting the first receiving surface.

17. A liquid ejection device comprising:

an ejection head including a nozzle;

a cap having a top side proximate the ejection head, the cap configured to cover the nozzle;

a first liquid receiver including a first receiving surface positioned under the top side of the cap and a discharge portion connected to the first receiving surface, the discharge portion extending in a direction intersecting the first receiving surface; and a second liquid receiver including a second receiving surface positioned under the discharge portion, wherein one of the first liquid receiver and the second liquid receiver has an engagement portion, and the other of the first liquid receiver and the second liquid receiver has an engaged portion, wherein play between the engagement portion and the engaged portion in a direction parallel to the second receiving surface is smaller than a distance between both ends of the second receiving surface in the direction parallel to the second receiving surface, wherein the first liquid receiver includes a sidewall protruding from an edge of the first receiving surface, the sidewall including an inner surface, and wherein the inner surface of the sidewall has an upper end having a tapered shape that is inclined downward toward the center of the first liquid receiver.

18. A liquid ejection device comprising:

an ejection head including a nozzle;

a cap having a top side, the cap configured to cover the nozzle;

a first liquid receiver including a first receiving surface positioned under the top side of the cap and sidewalls, wherein at least one of the first receiving surface and the sidewalls include an outlet; and a second liquid receiver including a second receiving surface positioned under the outlet, such that the second liquid receiver and the first liquid receiver are movable relative to each other in a direction that includes at least one component in a horizontal direction, the second receiving surface configured to receive liquid discharged through the outlet.

19. A liquid ejection device comprising:

an ejection head including a nozzle;

a cap having a top side, the cap configured to cover the nozzle;

a first liquid receiver including a first receiving surface positioned under the top side of the cap and sidewalls, wherein at least one of the first receiving surface and the sidewalls include an outlet;

a second liquid receiver including a second receiving surface positioned under the outlet, the second receiving surface configured to receive liquid discharged through the outlet; and a support structure that supports at least one of the first liquid receiver and the second liquid receiver, wherein the at least one of the first liquid receiver and the second liquid receiver includes at least two surfaces that are spaced from the support structure to permit relative play between the at least one of the first liquid receiver and the second liquid receiver and the support structure.

20. The liquid ejection device according to claim 19, further comprising:

a discharge portion connected to the outlet and extending away from the first receiving surface to a distal end of the discharge portion spaced from the first receiving surface in an extending direction away from the cap.

* * * * *